US010603911B2

(12) United States Patent
Chen et al.

(10) Patent No.: US 10,603,911 B2
(45) Date of Patent: Mar. 31, 2020

(54) PRINTHEAD

(71) Applicant: Hewlett-Packard Development Company, L.P., Houston, TX (US)

(72) Inventors: Chien-Hua Chen, Corvallis, OR (US); Michael W. Cumbie, Albany, OR (US); Silam J. Choy, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/749,073

(22) PCT Filed: Oct. 12, 2015

(86) PCT No.: PCT/US2015/055086

§ 371 (c)(1),
(2) Date: Jan. 30, 2018

(87) PCT Pub. No.: WO2017/065725

PCT Pub. Date: Apr. 20, 2017

(65) Prior Publication Data

US 2018/0222194 A1 Aug. 9, 2018

(51) Int. Cl.

| | |
|---|---|
| ***B41J 2/14*** | (2006.01) |
| ***B41J 2/16*** | (2006.01) |
| ***B41J 2/155*** | (2006.01) |

(52) U.S. Cl.

CPC ..... *B41J 2/14072* (2013.01); *B41J 2/155* (2013.01); *B41J 2/1603* (2013.01); *B41J 2/1626* (2013.01);

(Continued)

(58) Field of Classification Search

CPC ..... B41J 2/14; B41J 2/14016; B41J 2/1404; B41J 2/14072; B41J 2/1433; B41J 2/155;

(Continued)

(56) References Cited

U.S. PATENT DOCUMENTS 4,533,921 A 8/1985 Goff et al.
5,160,945 A * 11/1992 Drake ..... B41J 2/155 347/42

(Continued)

FOREIGN PATENT DOCUMENTS

| | | |
|---|---|---|
| CN | 101128556 | 2/2008 |
| CN | 101233073 | 7/2008 |
| WO | WO-2014153305 | 9/2014 |

OTHER PUBLICATIONS

The International Searching Authority, "The International Search Report and The Written Opinion, PCT Application No. PCT/US2015/055086", dated Jun. 30, 2016, 14 pages.

(Continued)

*Primary Examiner* — Anh T Vo
(74) *Attorney, Agent, or Firm* — HP Inc. Patent Department

(57) ABSTRACT

A printhead includes a moldable substrate, and a number of printhead dies molded into the moldable substrate. The printhead dies include a number of printhead dies molded into the moldable substrate. The dies comprise a non-rectangular shape. A number of fluid slots are defined in the moldable substrate to fluidically coupled to the printhead dies to feed fluid to the printhead dies. The number of fluid slots is not equal to the number of printhead dies.

18 Claims, 12 Drawing Sheets

(52) U.S. Cl.
CPC ..... *B41J 2/1628* (2013.01); *B41J 2/1629* (2013.01); *B41J 2/1632* (2013.01); *B41J 2/1634* (2013.01); *B41J 2/1635* (2013.01); *B41J 2/1637* (2013.01); *B41J 2202/20* (2013.01)

(58) Field of Classification Search
CPC ..... B41J 2/1603; B41J 2/1626; B41J 2/1628; B41J 2/1629; B41J 2/1632; B41J 2/1634; B41J 2/1635; B41J 2/1637; B41J 2202/20; B29C 64/112; B29C 64/02
See application file for complete search history.

(56) References Cited

U.S. PATENT DOCUMENTS

| | | | | |
|---|---|---|---|---|
| 5,696,544 | A * | 12/1997 | Komuro | B41J 2/155 347/50 |
| 6,068,367 | A | 5/2000 | Fabbri | |
| 6,188,414 | B1 | 2/2001 | Wong et al. | |
| 6,234,605 | B1 * | 5/2001 | Hilton | B41J 2/15 347/13 |
| 6,341,845 | B1 * | 1/2002 | Scheffelin | B41J 2/155 347/42 |
| 6,350,013 | B1 * | 2/2002 | Scheffelin | B41J 2/14024 347/42 |
| 6,394,580 | B1 | 5/2002 | Scheffelin et al. | |
| 6,450,614 | B1 | 9/2002 | Scheffelin et al. | |
| 6,869,165 | B2 * | 3/2005 | Martin | B41J 2/14072 347/13 |
| 6,869,166 | B2 * | 3/2005 | Brugue | B41J 2/145 347/13 |
| 7,828,417 | B2 * | 11/2010 | Haluzak | B41J 2/16 347/49 |
| 9,446,587 | B2 * | 9/2016 | Chen | B41J 2/14072 |
| 2002/0033861 | A1 | 3/2002 | Boyd et al. | |
| 2002/0118254 | A1 | 8/2002 | Wong et al. | |
| 2011/0018941 | A1 | 1/2011 | McAvoy et al. | |
| 2011/0037808 | A1 | 2/2011 | Ciminelli et al. | |
| 2011/0080450 | A1 | 4/2011 | Ciminelli et al. | |
| 2012/0188308 | A1 | 7/2012 | Fang et al. | |
| 2012/0212540 | A1 | 8/2012 | Dietl | |
| 2013/0120504 | A1 | 5/2013 | Yanata et al. | |
| 2014/0028748 | A1 | 1/2014 | Hudd et al. | |
| 2014/0264954 | A1 * | 9/2014 | Wong | H01L 25/50 257/787 |
| 2015/0210076 | A1 | 7/2015 | Rivas et al. | |
| 2016/0009084 | A1 * | 1/2016 | Chen | B41J 2/155 347/44 |
| 2017/0066242 | A1 | 3/2017 | Chen et al. | |
| 2017/0334211 | A1 | 11/2017 | Chen et al. | |
| 2018/0154632 | A1 | 6/2018 | Chen et al. | |
| 2018/0361746 | A1 | 12/2018 | Chen et al. | |

OTHER PUBLICATIONS

Watanabe, S. et al. "High Quality, High Speed, Next-generation Inkjet Technology with Scalability From Serial Printheads to Lineheads", Jan. 1, 2014, 1 page.

* cited by examiner

PRINTHEAD

CLAIM FOR PRIORITY

The present application is a national stage filing under 35 U.S.C. § 371 of PCT application number PCT/US2015/055086, having an international filing date of Oct. 12, 2015, the disclosure of which is hereby incorporated by reference in its entirety.

BACKGROUND

Printing devices contain a number of printheads used to dispense ink or another jettable fluid onto a print medium. The printheads include a number of dies that are precision dispensing devices that precisely dispense the jettable fluid to form an image on the print medium. The jettable fluid may be delivered via a fluid slot defined in the print head to an ejection chamber beneath a nozzle. Fluid may be ejected from the ejection chamber by, for example, heating a resistive element. The ejection chamber and resistive element form the thermal fluid ejection device of a thermal inkjet (TIJ) printhead. The printing devices may, however, use any type of digital, high precision liquid dispensing system, such as, for example, two-dimensional printing systems, three-dimensional printing systems, digital titration systems, and piezoelectric printing systems, among other types of printing devices.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
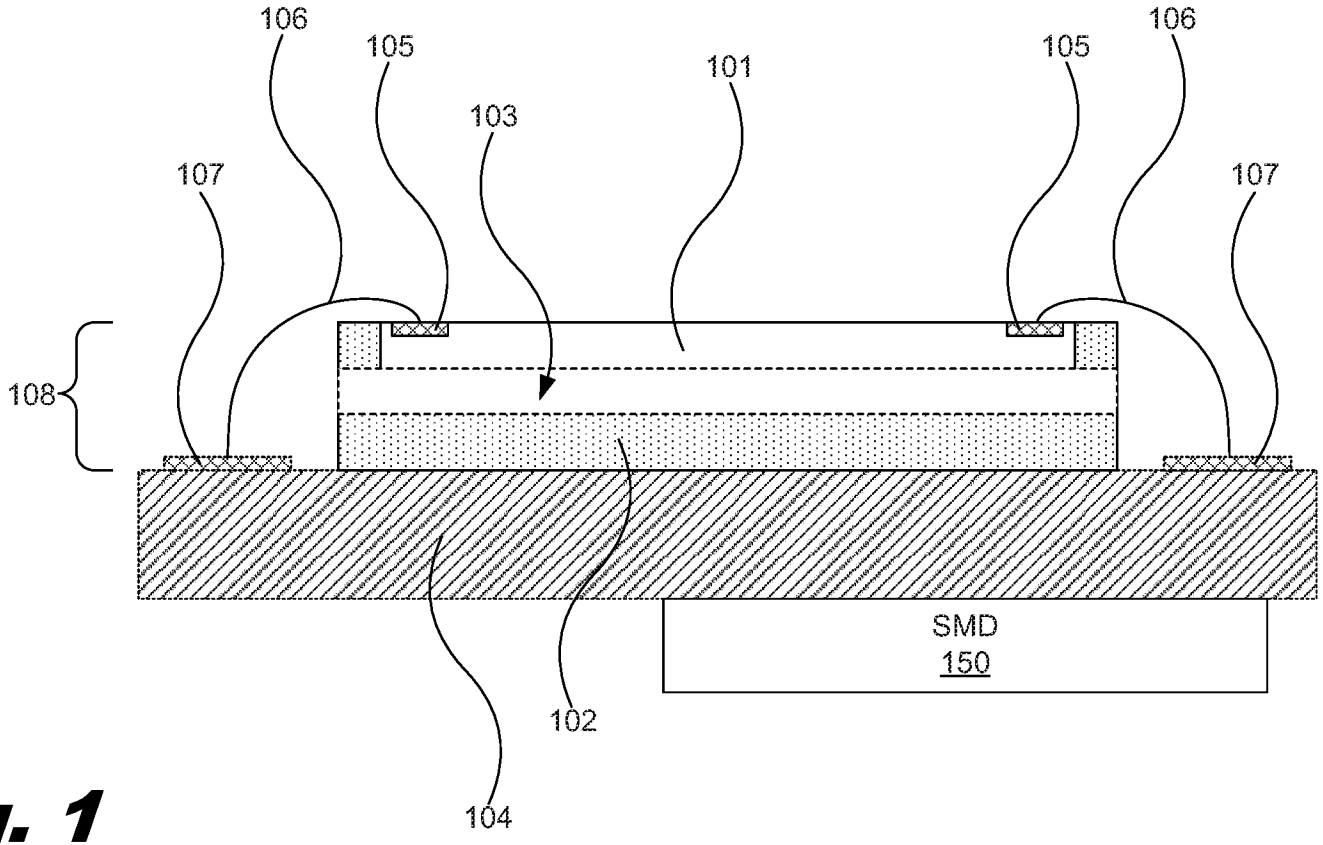
FIG. 1 is a cross-sectional diagram of a printhead die overmolded into a moldable substrate, according to one example of the principles described herein.

Each printhead die in an inkjet printhead such as those included in a print cartridge or a print bar includes a number of slots that channel ink to the ejection chambers. Ink is distributed from an ink supply to the ink slots through passages in a structure that supports the printhead die(s) on the printhead. In order to make manufacturing of printheads more cost effective by utilizing less materials such as silicon within the printheads, it may be desirable to shrink the size of each printhead die and the printheads.

While thermal inkjet (TIJ) devices are described throughout the examples herein, any type of digital, high precision liquid dispensing system may utilize these examples. For example, the printhead may include any two-dimensional (2D) printing elements or devices, any three-dimensional (3D) printing elements or devices, digital titration elements or devices, piezoelectric printing elements or devices, other types of digital, high precision liquid dispensing system, or combinations thereof. These various types of liquid dispensing systems may dispense a myriad of types of liquids including, for example, inks, 3D printing agents, pharmaceuticals, lab fluids, and bio-fluids, among other dispensable liquids. The 3D printing agents may include, for example, polymers, metals, adhesives, 3D inks, among others.

Materials used to form inkjet printheads restrict the ability to obtain a printhead die with a tighter slot pitch or ink slot width. Higher TIJ die separation ratios or lower die costs are proportional to tighter slot pitch or ink slot width. From a cost point of view, ink slots take up useful die space and have significant processing cost. This is especially true if the complexity of ink slot integration and unexpected side effects are considered. From the point of view of the printhead assembly, a tight slot pitch may be more challenging on multiple technological or reliability fronts such as chiclet fan-out, joining, and air bubble management, among others. Thus, examples described herein provide various die shapes and ink slot arrangements that enable molded printheads to be used in, for example, a page-wide array (PWA) printing devices.

More specifically, a thermal inkjet (TIJ) printhead includes a number of TIJ printhead dies. Each TIJ die includes a number of rows of nozzles. A printhead die includes at least one thin silicon, glass or other substrate having a thickness on the order of approximately 650 μm or less. The printhead dies may each include a number of fluid ejection devices such as the above-mentioned resistive heating elements below the rows of nozzles. Jettable fluid may flow to the ejection devices of the printhead dies through a number of fluid slots formed in the substrate between opposing substrate surfaces.

While such fluid slots effectively deliver fluid to the fluid ejection elements, the fluid slots occupy valuable silicon real estate and add significant processing cost in their fabrication. Lower printhead die costs may be achieved in part through shrinking the die size. However, a smaller die size results in a tighter slot pitch and/or a narrower slot width in the silicon substrate, which adds excessive assembly costs associated with integrating the smaller printhead die into the printhead. Further, removing material from the substrate to form an ink delivery slot structurally weakens the printhead die. Thus, when a single printhead die has multiple slots to improve print quality and speed in a single color printhead die, or to provide different colors in a multicolor printhead die, the printhead die becomes increasingly fragile with the addition of each slot. Thus, one constraint within a TIJ printhead is that higher printhead die separation ratios or lower die costs are proportional to tighter slot pitch or fluid slot width. From a cost point of view, a fluid slot may occupy useful die space and may have significant processing cost.

Stating it in another way, reducing the cost of inkjet printhead dies may include shrinking the die size and reducing wafer costs. The die size may depend on the pitch of fluid delivery slots formed through the silicon substrate that deliver jettable fluid from a reservoir on one side of the die to fluid ejection elements of the rows of nozzles on another side of the die. Therefore, some methods to shrink the die size may involve reducing the slot pitch and size through a silicon slotting process that may include, for example, laser machining, anisotropic wet etching, dry etching, other material removal methods, or combinations thereof. However, the silicon slotting process adds considerable manufacturing costs to the printhead die. Further, as die sizes have decreased, the costs and complexities associated with integrating the smaller dies into an inkjet printhead have begun to exceed the savings gained from the smaller dies. Furthermore, as die sizes have decreased, the removal of die material to form ink delivery slots has had an increasingly adverse impact on die strength, which can increase die failure rates.

In one example, an overmold of epoxy mold compound (EMC) may be used to hold multiple rows of nozzles of a printhead die in place. The inexpensive molded substrate formed by the EMC also provides physical support for interconnect traces, supports wire bonding, and enables TAB bonding in various examples. Overmolded printhead die have three times a reduction in cost. Further, the overmolded printhead die simplify the printhead assembly process since chiclets or other fluid distribution manifolds or fluidic interposers are no longer needed within the printhead. To further reduce the cost, electrical interconnects are extended from the rows of nozzles to printed circuit boards (PCB) or lead frames. The PCBs or lead frames connect the rows of nozzles to the edge of the die so the printhead can be connected to an electrical contact of a printing device directly instead of using expensive tape-automated bonding (TAB) circuits or surface-mounted technology (SMT) connectors. Thus, the overmolded printhead dies and their respective electrical interconnects greatly simplify the printhead design and assembly process.

Examples described herein provide a printhead that includes a moldable substrate, and a number of dies molded into the moldable substrate. The dies include a number of rows of nozzles. The rows of nozzles form the dies within the printhead.

The dies may include a non-rectangular shape. The non-rectangular shaped dies include an S-shape, a stepped die edge shape, a staired die edge shape, a slopped die edge shape, a chamfered die edge shape, a pentangle die edge shape, or combinations thereof. In one example, the non-rectangular shaped dies may be shaped using a stealth dicing process.

The number of dies molded into the moldable substrate includes a plurality of dies. In this example, the non-rectangular shaped dies may be arranged in a stitching configuration wherein ejection of fluid from a number of nozzles within overlapping portions of the plurality of dies is adjusted. Further, the plurality of die may be overmolded together in the same moldable substrate.

The moldable substrate includes a number of fluid slots defined within the moldable substrate to feed fluid to the printhead dies. In one example, the fluid slots defined within the moldable substrate are narrower than a width of a printhead die. In another example, the fluid slots defined within the moldable substrate are wider than a width of a printhead die. The moldable substrate comprises a number of vias defined in the moldable substrate. In this example, a number of wire bonds electrically couple the plurality of die to a printed circuit board (PCB) through the vias.

Examples described herein provide a printhead including a moldable substrate, and a number of printhead dies molded into the moldable substrate. The printhead further includes a number of fluid slots defined in the moldable substrate to fluidically coupled to the printhead dies to feed fluid to the printhead dies. In one example, the number of fluid slots is not equal to the number of printhead dies.

In one example, a plurality of the fluid slots are fluidically coupled to a single die. In another example, a single fluid slot defined within the moldable substrate is fluidically coupled to at least two dies. Further, in one example, at least one of the fluid slots defined in the moldable substrate has a non-centered alignment with respect to one of the dies.

In these examples, the die does not comprise a fan-out chiclet. In this manner, a significant reduction in fabrication costs may be realized by not including a fan-out chiclet.

Examples described herein provide a method of forming a printhead. The method includes overmolding at least one printhead die into a moldable substrate. In one example, a number of printhead dies form the printhead.

The method may include defining a number of fluid slots in the moldable substrate on a non-ejection side of the printhead dies to feed fluid to the printhead dies, and electrically coupling the plurality of printhead dies to a controller of a printing device. The plurality of printhead dies may be electrically coupled to the controller as a number of groups of printhead dies.

The method may further include defining a number of vias in the moldable substrate through which a number of wire bonds are extended. The wire bonds electrically couple the printhead dies to the controller.

As used in the present specification and in the appended claims, the terms "printhead" is meant to be understood broadly as any device that within a printer or other inkjet type dispenser that can dispense jettable fluid from a number of nozzle openings from a number of printhead dies included within the printhead. Further, as used in the present specification and in the appended claims, the term "printhead die" is meant to be understood broadly as the part of a printhead that can dispense jettable fluid from a number of nozzle openings defined within the printhead die. A printhead includes a number of printhead dies. For example, a printhead may include a single printhead die such as, for example, a die included within a printer cartridge. In another example, a printhead may include a plurality of printhead dies such as, for example, dies included within a print bar of a page wide array. The printhead may span a width of a print media on which the printhead dispenses jettable fluid. Further, the printhead dies included in a printhead may be arranged in a number of different arrangements as will be described in more detail below.

Further, the printhead dies each include a silicon substrate, electrical circuitry to couple the printhead dies to a printing device, circuitry to signal ejection of and to eject jettable fluid from the printhead dies including, for example, a number of transistors, a number micro-electromechanical system (MEMS) devices, and a number of resistive heating elements. Each printhead die also includes a number of rows of nozzles. A printhead and printhead die are not limited to dispensing ink and other printing fluids, but instead may also dispense other fluids for uses other than printing.

Each printhead die is fluidically coupled to at least one fluid (e.g., ink) slot. The ink slot may be defined in a moldable substrate into which the printhead die(s) are overmolded. In one example, the ink slots may span a plurality of printhead dies. In other words, in this example, a single ink slot may fluidically couple to a plurality of printhead dies. The size, location, and arrangement of the ink slots may vary, and examples of these variations will be described in more detail below.

In one example, the printhead dies may be any high-aspect ratio die. In one example, the printhead dies may include thin silicon or glass substrate having a width of approximately 500 μm or less, and a ratio of length to width (L/W) of at least three. The printhead dies may also include an epoxy-based negative photoresist material such as SU-8 layered on the silicon or glass substrate that makes up the nozzles of the printhead dies. In one example, a number of rows of nozzles and their respective corresponding circuitry and resistive heating elements may be included within a printhead die. Thus, a single row of nozzles and their respective corresponding circuitry and resistive heating elements may make up a printhead die. Further, a printhead die including two or more rows of nozzles and their respective corresponding circuitry and resistive heating elements is also a printhead die.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

FIG. 1 is a cross-sectional diagram of a printhead die (101) overmolded into a moldable substrate (102), according to one example of the principles described herein. In one example, the moldable substrate (102) is an epoxy molding compound (EMC). Epoxy molding compound (EMC) is broadly defined herein as any material including at least one epoxide functional group. In one example, the EMC is a self-cross-linking epoxy. In this example, the EMC may be cured through catalytic homopolymerization. In another example, the EMC may be a polyepoxide that uses a co-reactant to cure the polyepoxide. Curing of the EMC in these examples forms a thermosetting polymer with high mechanical properties, and high temperature and chemical resistance.

The moldable substrate (102) may be monolithic wherein a single piece of moldable substrate (102) is formed. In one example, the monolithic moldable substrate (102) may be cut or separated to provide separate printhead dies. In another example, the monolithic moldable substrate (102) may be formed such that a plurality of printhead dies (101) are included together in the same monolithic moldable substrate (102).

The moldable substrate (102) may be formed using, for example, a transfer molding process for making a molded printhead fluid flow structure including a number of transfer molded ink slots (103). In the transfer molding process a number of printhead dies (101) may be overmolded using a transfer mold that includes or creates cavities with respect to the printhead dies (101). The cavities are filled with the epoxy molding compound (EMC) or other suitable moldable material. Filling the cavities with the EMC forms the molded substrate (102) that encapsulates the printhead dies (101), and also forms the molded ink slots within the molded substrate (102). In one example, filling the cavities with the EMC involves preheating the EMC until it reaches a melting temperature and becomes a liquid. A vacuum may be created within the cavities, and the liquid EMC may be injected using a plunger, for example, through channels of the mold chase until it reaches and fills the cavities. When the EMC cools and hardens to a solid, the transfer mold is removed. The transfer mold may have varying topographies to form differently shaped transfer molded ink slots (103) into the body of the molded substrate (102). Thus, in this implementation the molded printhead die (101) structure may be formed in a transfer mold process. The use of a mold in a transfer molding process enables the formation of many differently shaped ink slots and fluid channels.

The printhead dies (101) each include an epoxy-based negative photoresist material such as SU-8 layered on the silicon or glass substrate. The thin silicon, glass, or other substrate may have a thickness of approximately 650 μm or less, and may also have a ratio of length to width (L/W) of at least three. In one example, the number of printhead dies (101) is equivalent to the number of colors of jettable fluid the printhead die (101) ejects. For example, the printhead die may include four printhead dies (101) for cyan (C), magenta (M), yellow (Y), and black (K). However, any color model or colors may be represented by the printhead dies (101).

Each printhead die (101) includes a number of nozzles defined in an epoxy-based negative photoresist where portions of the negative photoresist exposed to ultraviolet (UV) radiation become cross-linked, while the remainder of the film remains soluble and can be washed away during development. In one example, the negative photoresist is SU-8. The nozzles are coupled to a silicon substrate that includes a number of ink feed slots (103) defined therein as depicted in FIG. 1 with a dash-lined box. An additional portion of epoxy-based negative photoresist may be included in the printhead dies (101) to act as a dam to prevent the molding compound of the EMC (102) from contacting connection pads, bonding wires, or other electrical connections. This additional portion of epoxy-based negative photoresist that surrounds the electrical connection regions prevents excess flash molding material from entering the electrical connection regions during a molding process.

Further, each printhead die (101) includes at least one ejection chamber beneath each nozzle. The ejection chamber is fluidically coupled to a number of slots (103) defined within the moldable substrate (102) beneath the printhead die (101) through which jettable fluid flows to the ejection chambers and out the nozzles during a firing event of the jettable fluid. Each printhead die (101) is molded into the monolithic moldable substrate (102) that includes a number of fluid (e.g. ink) slots (103) that provide formed into the moldable substrate (102) at the back surface of the printhead dies (101). Thus, a molded printhead structure avoids significant costs otherwise associated with die slotting processes and the related assembly of slotted dies into manifold features (e.g., chiclets) of the printhead die (101).

In one example, the printhead die (101) may be coupled to a printed circuit board (PCB) substrate (104). In the examples described herein, a PCB may be embedded or coupled to the moldable substrate (102). The dash-lined box indicating the PCB (104) indicates that the PCB (104) is an optional element, and may or may not be coupled to the printhead die (101). In one example, the PCB is a FR-4 (fire retardant-4) grade PCB. An FR-4 grade PCB denotes a glass-reinforced epoxy laminate sheet. FR-4 PCB is a composite material composed of woven fiberglass cloth with an epoxy resin binder that is flame resistant or self-extinguishing. The "FR-4" designation denotes that safety of flammability of FR-4 is in compliance with the standard UL94V-0. In one example, FR-4 may be created from a number of materials including epoxy resin, woven glass fabric reinforcement, brominated flame retardant, or combinations thereof, and is a versatile high-pressure thermoset plastic laminate grade with good strength to weight ratios. With near zero water absorption, an FR-4 grade PCB may be used as an electrical insulator possessing considerable mechanical strength, and retains its high mechanical values and electrical insulating qualities in both dry and humid conditions. Further, an FR-4 grade PCB substrate has good fabrication characteristics. Details regarding an embedded or coupled PCB will be described below.

In one example, a number of surface mount devices (SMD) (150) may be mounted on a non-ejection side of the PCB (104). The SMD may include application specific integrated circuits (ASICs) to process signals sent to and from the printhead dies (101), a number of low profile connectors to electrically and communicatively couple the printhead dies (101) to a printing device (1100), other SMDs, or combinations thereof. The SMDs (150) are mounted on the non-ejection side of the PCB (104) so that the The printhead die (101) may include a number of connection pads (105) to electrically couple the printhead die (101) to a controller of a printing device into which the printhead die (101) is incorporated. A number of wire bonds (106) couple the connection pads (105) to a number of PCB pads (107). Traces may be used throughout the PCB to move electrical signals from the controller of a printing device to the printhead die (101).

The molded printhead dies (101) may be arranged in a stitching configuration where a number of the printhead dies (101) overlap an adjacent number of the printhead dies (101). In this example, the overlap of the printhead dies (101) allows for nozzle stitching of those nozzles of the printhead dies (101). Stitching of the nozzles may be accomplished, in one example, by timing the firing of any overlapping nozzles such that the combined firing of ejection fluid from the overlapped nozzles does not eject any more or less jettable fluid than other non-overlapping nozzles.

Throughout the examples described here, a printhead may include a number of printhead dies (101) (e.g., one or more printhead dies (101)) molded within a moldable substrate (102). Thus, the examples described herein, each printhead may include a single printhead die (101). However, in other examples, each printhead may include a plurality of printhead dies (101). Throughout the remainder to the figures, element 108 depicted in FIG. 1 is meant to refer to the printhead as a combination of the printhead dies (101) and the moldable substrate (102) and any ink slots (103) defined in the moldable substrate (102). The elements described in connection with FIG. 1 are present throughout the examples described herein.

Figure 2A:
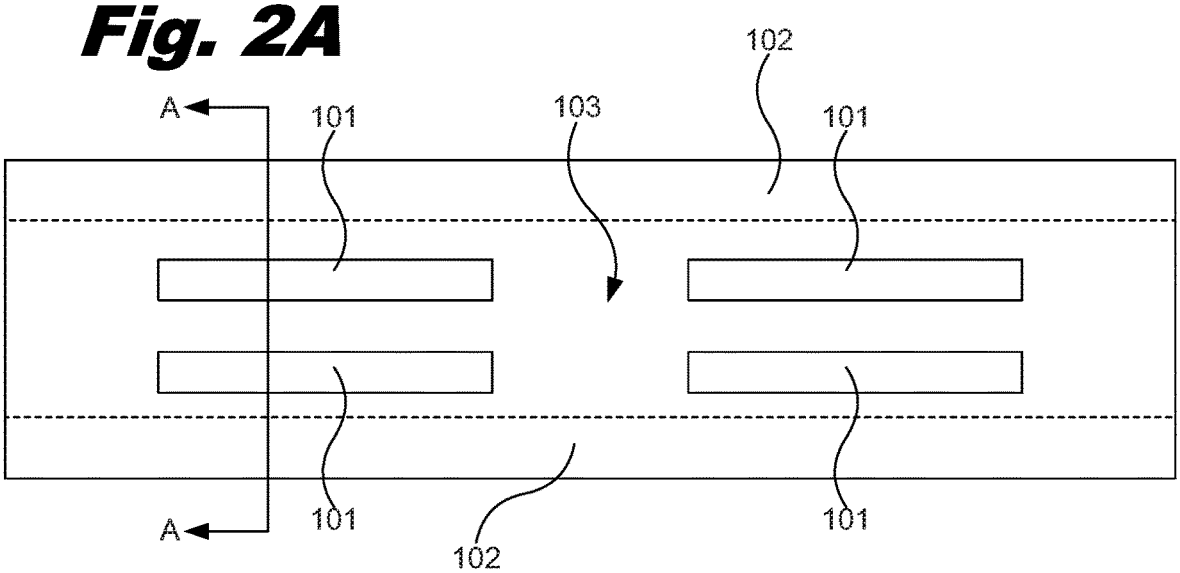
FIG. 2A is a top diagram of a plurality of printhead dies overmolded into a moldable substrate with an ink slot fluidly coupled to and spanning the plurality of printhead dies, according to one example of the principles described herein.

For example, FIG. 2A is a top diagram of a plurality of printhead dies (101) overmolded into a moldable substrate (102) with an ink slot (103) fluidly coupled to and spanning the plurality of printhead dies (101), according to one example of the principles described herein. In association with FIG. 2A, FIG. 2D is a cross-sectional diagram of the overmolded printhead dies (101) of FIG. 2A along line "A," according to one example of the principles described herein. FIGS. 2A and 2D depict an example where a single ink slot (103) defined within the moldable substrate (102) is fluidically coupled to at least two printhead dies (101). The example of FIGS. 2A and 2D includes four printhead dies (101) that are fluidically coupled to the ink slot (103) such that ink travels from an ink supply to the ink slot (103) and into the ejection chambers of the printhead dies (101) to be ejected out the nozzles defined in the printhead dies (101). In the example of FIG. 2A, the jettable fluid (e.g., ink) that flows in ink slot (103) is a single color, and, therefore, the jettable fluid that is ejected from all the nozzles of the printhead dies (101) is the same color.

Further, as depicted in FIG. 2D, the printhead dies (101) include a number of nozzles (201) and ejection chambers (202) located beneath the nozzles (201). A number of resistive heating elements (203) may be disposed within the ejection chambers (202) to bring about a jettable fluid firing event so that the jettable fluid may be ejected from the nozzles (201). Further, FIGS. 2A and 2D depict the moldable substrate (102) surrounding all sides of the printhead dies (101). In one example depicted of FIGS. 2A and 2D, the printhead dies (101) may include a number of rows of nozzles. In another example of FIGS. 2A and 2D, the printhead dies (101) may include a plurality of rows of nozzles in each printhead die (101).

Figure 2B:
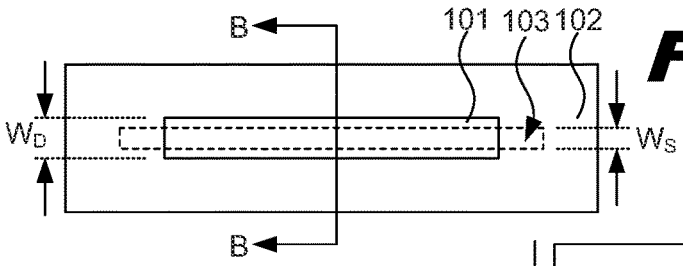
FIG. 2B is a top diagram of a printhead die overmolded into a moldable substrate with an ink slot narrower than the printhead die, according to one example of the principles described herein.

FIG. 2B is a top diagram of a printhead die (101) overmolded into a moldable substrate (102) with an ink slot (103) narrower than the printhead die (101), according to one example of the principles described herein. In association with FIG. 2B, FIG. 2E is a cross-sectional diagram of the overmolded printhead die (101) of FIG. 2B along line "B," according to one example of the principles described herein. In the example of FIGS. 2B and 2E, the width of the ink slots (103) (designated by "$W_S$") defined within the moldable substrate (102) is narrower than a width of a printhead die (101) (designated by "$W_D$"). This example allows for a tighter slot pitch to be achieved in a very low-cost manner compared to a silicon die and its fabrication with similar dimensions of an ink slot formed therein.

Figure 2C:
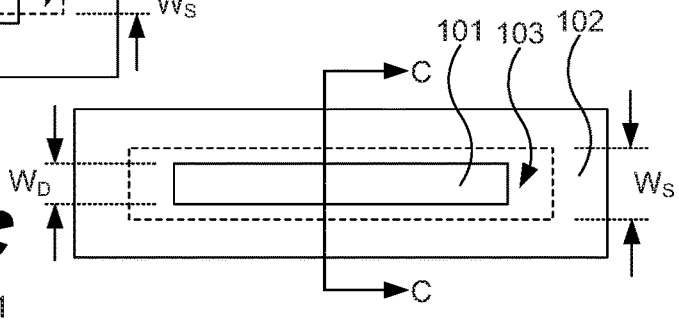
FIG. 2C is a top diagram of a printhead die overmolded into a moldable substrate with an ink slot wider than the printhead die, according to one example of the principles described herein.
Figure 2D:
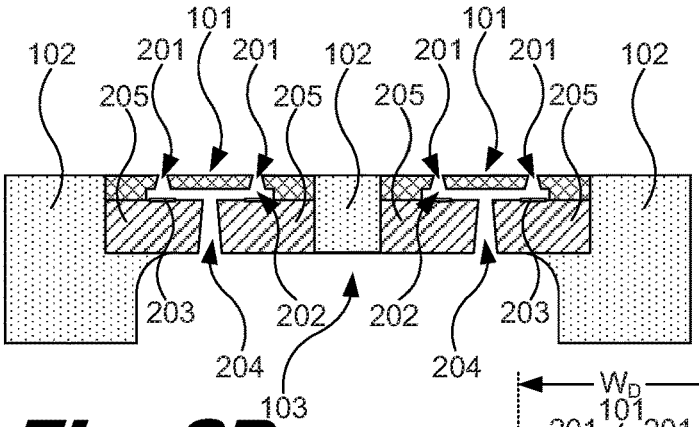
FIG. 2D is a cross-sectional diagram of the overmolded printhead dies of FIG. 2A along line "A," according to one example of the principles described herein.
Figure 2E:
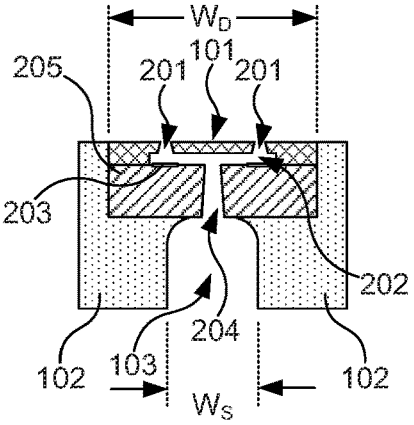
FIG. 2E is a cross-sectional diagram of the overmolded printhead die of FIG. 2B along line "B," according to one example of the principles described herein.
Figure 2F:
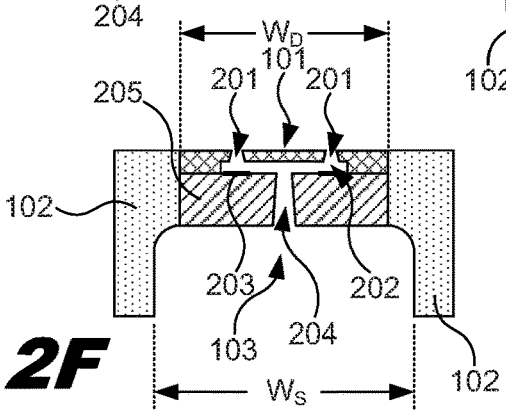
FIG. 2F is a cross-sectional diagram of the overmolded printhead die of FIG. 2C along line "C," according to one example of the principles described herein.

FIG. 2C is a top diagram of a printhead die (101) overmolded into a moldable substrate (102) with an ink slot (103) wider than the printhead die (101), according to one example of the principles described herein. In association with FIG. 2C, FIG. 2F is a cross-sectional diagram of the overmolded printhead die (101) of FIG. 2C along line "C," according to one example of the principles described herein. In the example of FIGS. 2C and 2F, the width ($W_S$) of the ink slots (103) defined within the moldable substrate (102) is wider than the width ($W_D$) of a printhead die (101). This example allows for a relatively less tight slot pitch compared to the examples of FIGS. 2B and 2E, but achieved the same low-cost fabrication. Further, in some situations, the width ($W_S$) of the ink slots (103) defined within the moldable substrate (102) may be wider than the width ($W_D$) of a printhead die (101) in order to ensure that a fluid with a high viscosity can flow through the ink slot (103) or to otherwise ensure that a functional amount of jettable fluid is present in the ink slot (103) and supplying the jettable fluid to the printhead dies (101).

Figures 3A, 3B, 3C, 3D, 3E:
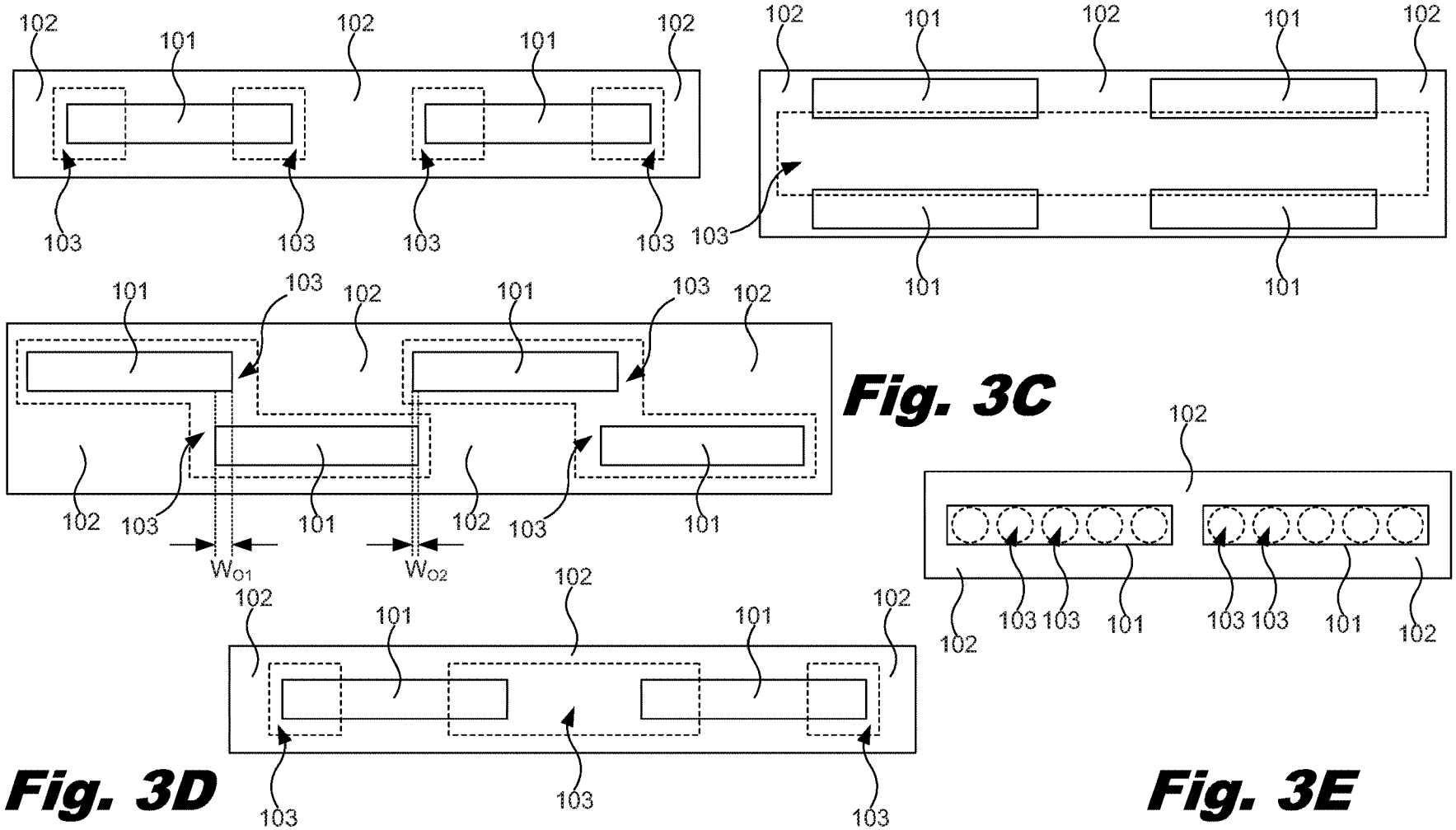
FIG. 3A is a top diagram of a plurality of printhead dies overmolded into a moldable substrate with a plurality of ink slots fluidly coupled to the ends of the plurality of printhead dies, according to one example of the principles described herein.
FIG. 3B is a top diagram of a plurality of printhead dies overmolded into a moldable substrate with an ink slot fluidly coupled to the sides of the plurality of printhead dies, according to one example of the principles described herein.
FIG. 3C is a top diagram of a plurality of printhead dies overmolded into a moldable substrate in a staggered configuration with a plurality of ink slots fluidly coupling a plurality of groups of printhead dies, according to one example of the principles described herein.
FIG. 3D is a top diagram of a plurality of printhead dies overmolded into a moldable substrate with a plurality of ink slots fluidly coupled to the ends of the plurality of printhead dies and spanning between the printhead dies in a daisy chain configuration, according to one example of the principles described herein.
FIG. 3E is a top diagram of a plurality of printhead dies overmolded into a moldable substrate with a plurality of ink feed holes fluidly coupled to the plurality of printhead dies, according to one example of the principles described herein.

A number of ink slot (103) and printhead die (101) or printhead die (101) configurations will now be described in connection with FIGS. 3A through 3E. First, FIG. 3A is a top diagram of a plurality of printhead dies (101) overmolded into a moldable substrate (102) with a plurality of ink slots (103) fluidly coupled to the ends of the plurality of printhead dies (101), according to one example of the principles described herein. Again, moldable substrate (102) may include any number of printhead dies (101) including a single printhead die (101) as well as a plurality of printhead dies (101). In the example of FIG. 3A, the printhead die (101) are feed jettable fluid such as ink at the end portions of the printhead die (101). In this manner, the jettable fluid travels from the ends of the printhead die (101) to the center. The arrangement of ink slots (103) relative to the printhead die (101) requires less fabrication. Further, FIG. 3A is an example wherein a plurality of the ink slots (103) are fluidically coupled to a single printhead die (103) as is the case with each of the two printhead dies (101) depicted in FIG. 3A.

FIG. 3B is a top diagram of a plurality of printhead dies (101) overmolded into a moldable substrate (102) with an ink slot (103) fluidly coupled to the sides of the plurality of printhead dies (101), according to one example of the principles described herein. FIG. 3B is an example where a single ink slot (103) defined within the moldable substrate (102) is fluidically coupled to at least two printhead dies (101). In the example of FIG. 3B, four printhead dies (101) are fluidically coupled to the single ink slot (103). In one example, the ink slot (103) extends underneath the printhead dies (101) through at least a portion of the printhead dies (101). However, in another example, the ink slot (103) may extend to the edge of each printhead dies (101). In each of these examples, the ink slot (103) is fluidically coupled to at least a portion of the printhead dies (101).

FIG. 3C is a top diagram of a plurality of printhead dies (101) overmolded into a moldable substrate (102) in a staggered configuration with a plurality of ink slots (103) fluidly coupling a plurality of groups of printhead die (101), according to one example of the principles described herein. The example of FIG. 3C may be referred to as including an s-shaped ink slot (103) with a number of printhead dies (101) included with the s-shaped ink slot (103). The printhead dies (101) fluidically coupled to the s-shaped ink slot (103) may share an overlap width ($W_{O1}$) where a portion of the printhead dies (101) overlap and a number of nozzles within each of the printhead dies (101) co-exist in the overlap width ($W_{O1}$). In this situation, the molded printhead dies (101) may be arranged in a stitching configuration where a number of the printhead dies (101) overlap an adjacent a number of the printhead dies (101). The overlap of the printhead dies (101) allows for nozzle stitching of those nozzles of the printhead dies (101). Stitching of the nozzles may be accomplished, in one example, by timing the firing of any overlapping nozzles such that the combined firing of ejection fluid from the overlapped nozzles does not eject any more or less jettable fluid than other non-overlapping nozzles.

Further, a number of groups of printhead dies (101) associated with the s-shaped ink slot (103) may overlap a certain width ($W_{O2}$) with another group of printhead dies (101) associated with a second s-shaped ink slot (103). In this situation, a nozzle stitching process may also be executed between the groups of printhead dies (101).

FIG. 3D is a top diagram of a plurality of printhead dies (101) overmolded into a moldable substrate (102) with a plurality of ink slots (103) fluidly coupled to the ends of the plurality of printhead dies (101) and spanning between the printhead dies (101) in a daisy chain configuration, according to one example of the principles described herein. In the example of FIG. 3D, two adjacent printhead dies (101) share a common ink slot (103) at adjacent ends of the print head dies (101). Although two adjacent printhead dies (101) are depicted in FIG. 3D, any number of printhead dies (101) may be included in the daisy chain configuration where adjacent printhead dies (101) share a common ink slot (103).

FIG. 3E is a top diagram of a plurality of printhead dies (101) overmolded into a moldable substrate (102) with a plurality of ink feed holes (301) fluidly coupled to the plurality of printhead dies (101), according to one example of the principles described herein. The ink feed holes (301) depicted in FIG. 3E act in a similar manner as the ink slots (103) in other examples described herein in that ink or another jettable fluid flows to the printhead dies (101) through the ink feed holes (301) and along the interior passageways of the printhead dies (101).

Figure 4A:
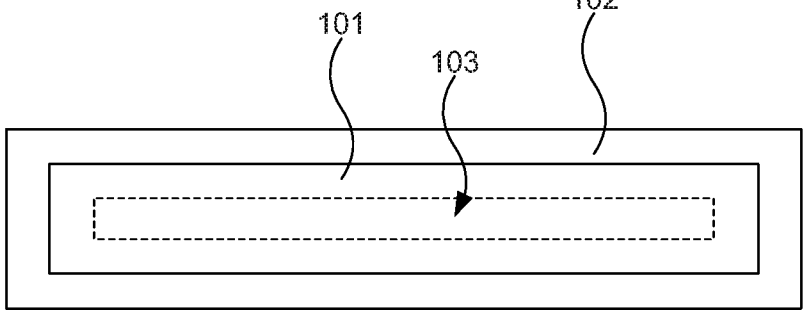
FIG. 4A is a top view diagram of a printhead die overmolded into a moldable substrate with an ink slot in center alignment with the printhead die, according to one example of the principles described herein.
Figure 4B:
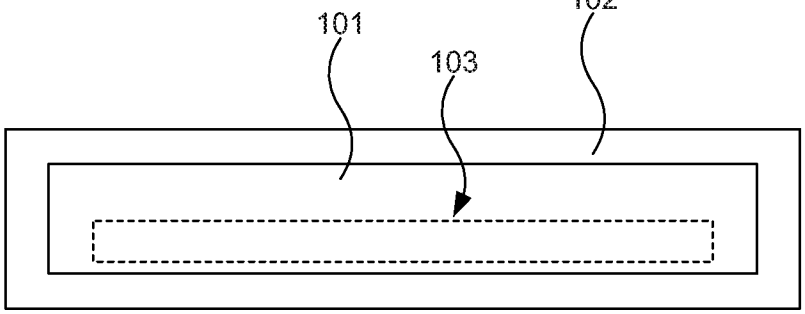
FIG. 4B is a top view diagram of a printhead die overmolded into a moldable substrate with an ink slot in offset vertical alignment with the printhead die, according to one example of the principles described herein.
Figure 4C:
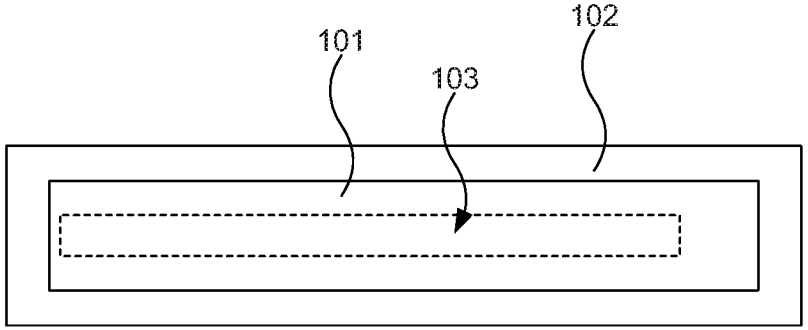
FIG. 4C is a top view diagram of a printhead die overmolded into a moldable substrate with an ink slot in offset horizontal alignment with the printhead die, according to one example of the principles described herein.
Figure 4D:
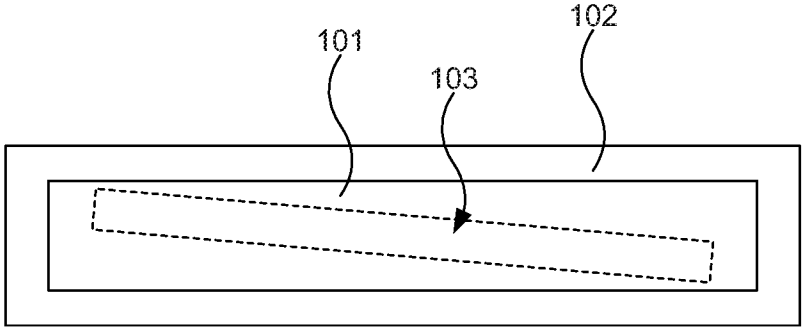
FIG. 4D is a top view diagram of a printhead die overmolded into a moldable substrate with an ink slot in rotated alignment with the printhead die, according to one example of the principles described herein.

Alignment of ink slots (103) with respect to printhead dies (101) will now be described in connection with FIGS. 4A through 4D. FIG. 4A is a top view diagram of a printhead die (101) overmolded into a moldable substrate (102) with an ink slot (103) in center alignment with the printhead die (101), according to one example of the principles described herein. The ink slot (103) may be centered both vertically with respect to the width of the printhead die (101) and horizontally with respect to the length of the printhead die (101). In contrast, FIG. 4B is a top view diagram of a printhead die (101) overmolded into a moldable substrate (102) with an ink slot (103) in offset vertical alignment with the printhead die (101), according to one example of the principles described herein. Further, FIG. 4C is a top view diagram of a printhead die (101) overmolded into a moldable substrate (102) with an ink slot (103) in offset horizontal alignment with the printhead die (101), according to one example of the principles described herein. In still another example, FIG. 4D is a top view diagram of a printhead die (101) overmolded into a moldable substrate (102) with an ink slot (103) in rotated alignment with the printhead die (101), according to one example of the principles described herein. The alignment of the ink slot (103) with respect to the printhead die (101) may be based on a desired shape and arrangement of the printhead die (101). The various arrangements within FIGS. 4A through 4D allow for a flexible way to minimize print zone size and optimize print performance.

The ink slot (103) arrangements described herein may be created during part of the molding process of the molded substrate (102) using the above-described transfer molding process or a compression molding process or can be created after a molding process with a laser, a mechanical saw, a router, a sand blaster, etching processes, other material ablation processes, or combinations thereof. The ink slots (103) may be wider or narrower than printhead dies (101), or shorter or longer than the printhead dies (101). Each printhead die (101 may have a single ink slot (103), a plurality of ink slots (103), and, in some cases, a plurality of printhead dies (101) may share a single ink slot (103).

Various shapes of the moldable substrates (102) of printheads will now be described in connection with FIGS. 5A-5D and 6A-6D. The moldable substrates (102) of the printheads may be individually formed or may be formed together on a common substrate to form an array of printheads or may be separated from one another using a laser, a mechanical saw, a router, a sand blaster, etching processes, other material ablation processes, or combinations thereof. Further, whether formed together or separated from one another, the printheads may be arranged with relation to one another in, for example, a page wide array. In these examples, the individual printheads may be arranged in a nesting arrangement where at least a portion of one printhead overlaps another printhead. Nozzle stitching processes as described above may be used to ensure that the nesting printheads eject jettable fluid in a manner that does not degrade the quality of a printed document produced by the printheads. The examples of moldable substrates (102) of printheads of FIGS. 5A-5D and 6A-6D may include a number of printheads dies including a single printhead die or a plurality of printhead dies.

Figure 5A:
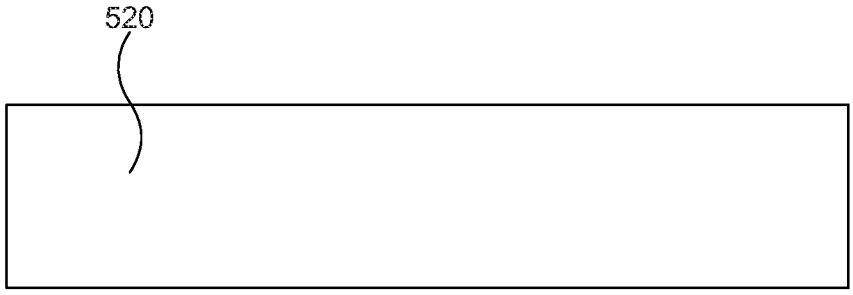
FIG. 5A is a diagram of a moldable substrate of a printhead with a rectangle shape, according to one example of the principles described herein.

FIG. 5A is a diagram of a moldable substrate (520) of a printhead with a rectangle die shape, according to one example of the principles described herein. However, in several examples, the printhead may include a non-rectangular shape. The various printhead die included in the moldable substrate (520) shapes of the printheads described herein may be fabricated from a silicon wafer where each of the individual printhead dies are separated from one another and shaped using, for example, a stealth dicing process. Stealth dicing is a laser-based cutting technique that works as a two-stage process in which certain regions of the wafer of printhead dies are introduced into the wafer by scanning the laser beam along intended cutting lines and an underlying carrier membrane is expanded to induce fracture of the wafer. A stealth dicing process does not require a cooling liquid, generates very little debris, and allows for improved exploitation of the wafer surface due to smaller kerf loss compared to, for example, a wafer saw.

The printhead dies may be overmolded into, for example, epoxy mold compound (EMC) to form the moldable substrate (102) with the overmolded printhead dies. Any number of printhead dies may be included within the moldable substrate (102) including a single printhead die and a plurality of printhead dies.

Figure 5B:
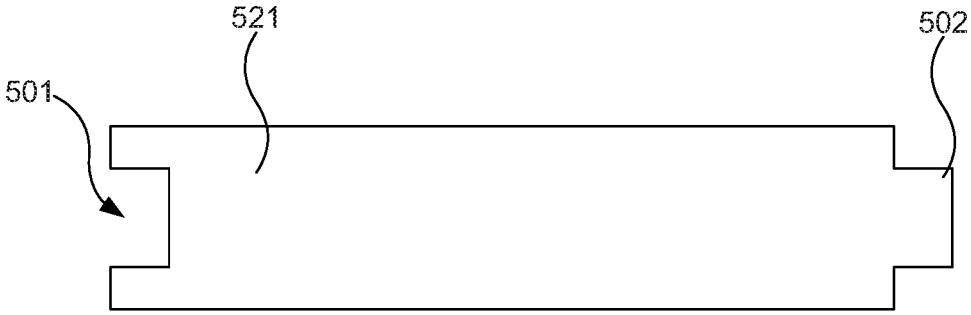
FIG. 5B is a diagram of a moldable substrate of a printhead with a stepped edge shape, according to one example of the principles described herein.

FIG. 5B is a diagram of a moldable substrate (521) of a printhead with a stepped die edge shape, according to one example of the principles described herein. In the example of FIG. 5B, printhead dies (101) with this shape may, when arranged in an array, nest or interlock with one another using the indentions (501) and protrusions (502) of each neighboring moldable substrate (521) to align and arrange the printheads with respect to one another.

Figure 5C:
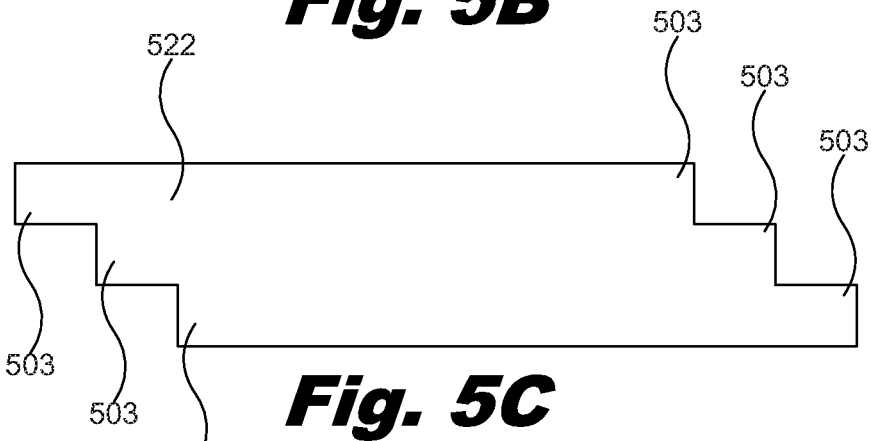
FIG. 5C is a diagram of a moldable substrate of a printhead with a stair-shaped edge, according to one example of the principles described herein.

FIG. 5C is a diagram of a moldable substrate (522) of a printhead with a stair-shaped edge, according to one example of the principles described herein. Like the example of FIG. 5B, the stair shape of the edges of the moldable substrate (522) of FIG. 5C are complimentary so that moldable substrate (522) with this shape may, when arranged in an array, nest or interlock with one another. This is done using the reciprocating stair-shaped edges (503) of each neighboring moldable substrate (522) to align and arrange the printheads with respect to one another. Any number of steps may be defined in the edges of the example of FIG. 5C.

Figure 5D:
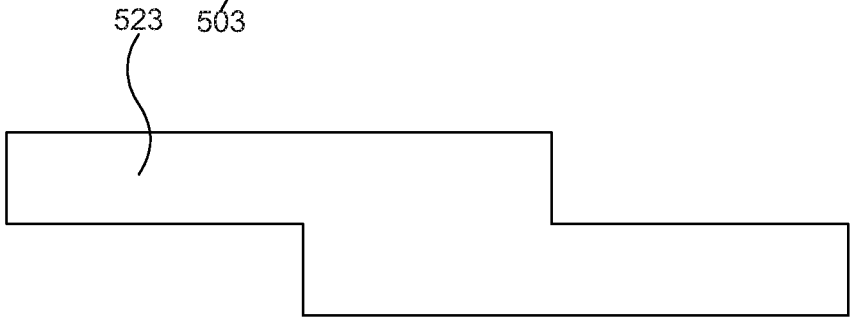
FIG. 5D is a diagram of a moldable substrate of a printhead with an s-shape, according to one example of the principles described herein.

FIG. 5D is a diagram of a moldable substrate (523) of a printhead with an s-shape, according to one example of the principles described herein. The example of FIG. 3C described above includes an s-shaped ink slot (103) with a number of printhead dies (101) included with the s-shaped ink slot (103). In such an example, the moldable substrate (523) may follow or be similar to the s-shaped ink slot (103) of FIG. 3C and may include, for example, two printhead dies (101) as depicted in FIG. 3C. Again, in this example, overlap of the two printhead dies (101) within the s-shape allows for nozzle stitching to occur as described herein.

Figure 6A:
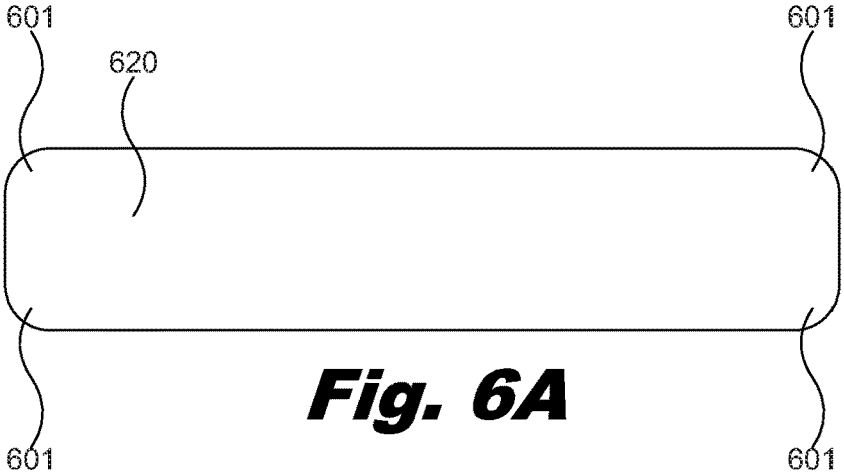
FIG. 6A is a diagram of a moldable substrate of a printhead with a chamfered edge shape, according to one example of the principles described herein.

FIG. 6A is a diagram of a moldable substrate (620) of a printhead with a chamfered edge shape, according to one example of the principles described herein. This example of a moldable substrate (620) may utilize fewer materials such as EMC and/or silicon on the edges in order to drive the cost of fabrication down, as the chamfered edges (601) do not require material to be formed at the corners of the moldable substrate (620).

Figure 6B:
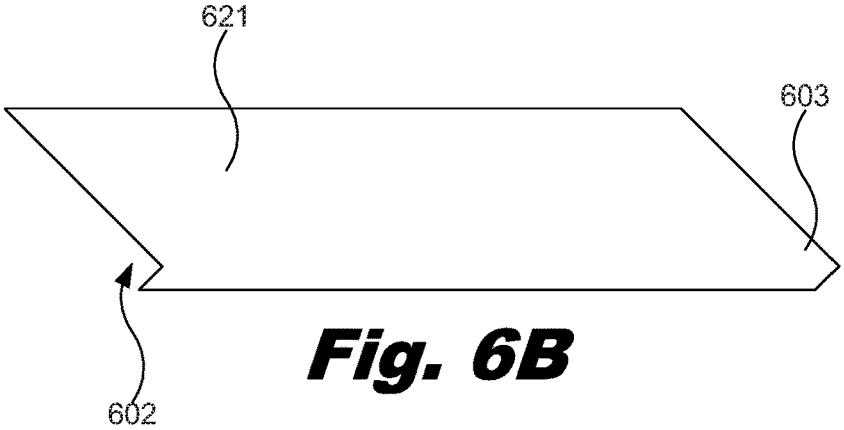
FIG. 6B is a diagram of a moldable substrate of a printhead with a sloped edge shape, according to one example of the principles described herein.

FIG. 6B is a diagram of a moldable substrate (621) of a printhead with a sloped edge shape, according to one example of the principles described herein. As is the case with other examples described herein, the sloped die edge shape of the moldable substrate (621) of FIG. 6B allows for a plurality of moldable substrates (621) to be arranged in an array and align the individual moldable substrates (621) with one another. Specifically, the indention (602) defined in the left side of the sloped die edge shape allows for the neighboring moldable substrate (621) to engage the indention (602) with a complimentary-fitting protrusion (603).

Figure 6C:
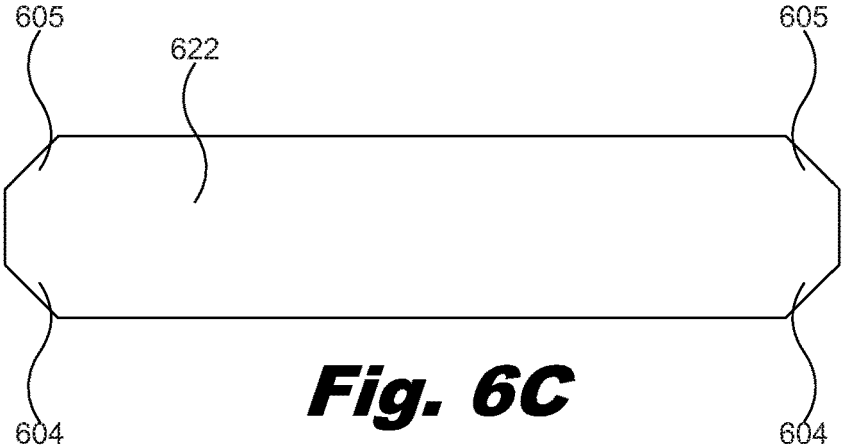
FIG. 6C is a diagram of a moldable substrate of a printhead with a polygonal edge shape, according to one example of the principles described herein.

FIG. 6C is a diagram of a moldable substrate (622) of a printhead with a polygonal edge shape, according to one example of the principles described herein. In this example, the moldable substrate (622) includes an angled bottom portion (604) that is able to interface with another moldable substrate (622) of this edge shape in a staggered configuration such that a bottom angled (604) portion of a first printhead die (101) interfaces with a top angled portion (605) of a second printhead die (101), or visa versa.

Figure 6D:
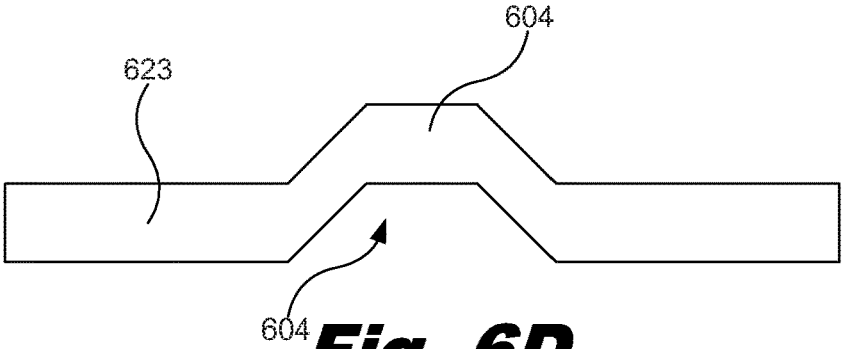
FIG. 6D is a diagram of a moldable substrate of a printhead with a shape including a plateau region, according to one example of the principles described herein.

FIG. 6D is a diagram of a moldable substrate (623) of a printhead with a shape including a plateau region, according to one example of the principles described herein. The example of FIG. 6D provides for the ability to arrange the moldable substrate (623) in a vertical alignment where the plateau region (606) of a first printhead interfaces with the indented portion (607) of the next printhead.

The various moldable substrate shapes described above in connection with FIGS. 5A-5D and 6A-6D are merely examples of different shapes of moldable substrates, and are not limiting. Any shape may be used during the formation of the moldable substrates and to form an array of moldable substrates, including shapes of any dimension, including any number of sides, edges, internal angles, lengths, and widths, including abstract shapes.

Figure 7A:
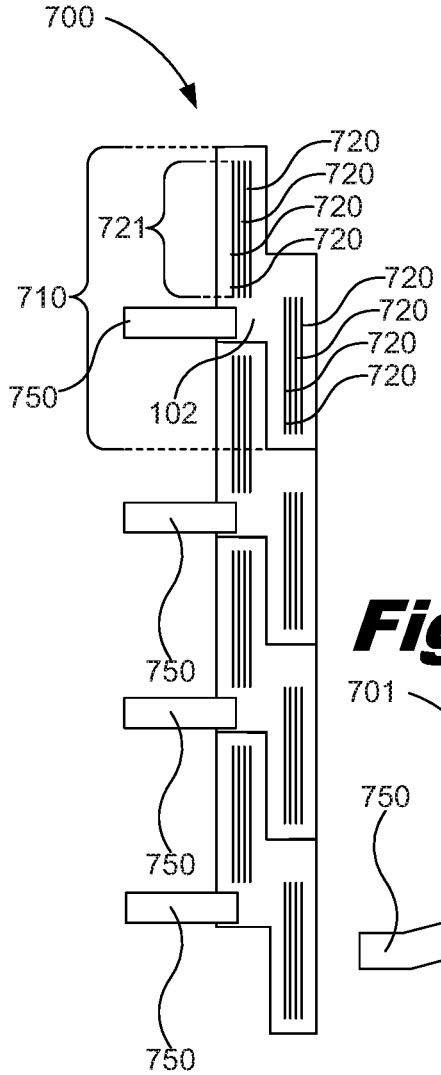
FIG. 7A is a diagram of a printhead array with s-shaped printheads in a tape-automated bonding (TAB) circuit interconnect arrangement, according to one example of the principles described herein.

The printheads of the examples described herein may be arranged in an array of printheads including a number of tape-automated bonding (TAB) circuit interconnect that, in some examples, may be used to form a print bar or a page-wide array (PWA). FIGS. 7A through 8D will now be described in connection with these arrangements of printheads within the moldable substrate (102), and the arrangement of printheads in a number of arrays. FIG. 7A is a diagram of a printhead array (700) with s-shaped printheads (710) in a tape-automated bonding (TAB) circuit interconnect arrangement, according to one example of the principles described herein. The printheads (710) may be arranged as depicted in FIG. 7A to form the printhead array (700). The printheads (710) of FIG. 7A include a plurality of printhead dies (720). In this example, each printhead die (720) includes a number of rows of nozzles (201) within each printhead die (720) and associated resistive heating elements and circuitry.

In one example, four different colors of jettable fluid (e.g., ink) are provided to four individual printhead dies (720) in a group (721) of printhead dies (720). However, any number of printhead dies (720) may be included within the printheads (710) and those printhead dies (720) may jet any number of colors of jettable fluid. For example, all four printhead dies (720) of the group (721) of printhead dies (720) depicted in FIG. 7A may eject black jettable fluid. In another example, our printhead dies (720) of the group (721) of printhead dies (720) depicted in FIG. 7A may eject different colors of jettable fluid such as, for example, cyan, magenta, yellow, and black. In another example more or less than four printhead dies (720) may be included within the group (721) of printhead dies (720). In still another example, any combination of number of the printhead dies (720) within the group (721) of printhead dies (720), and colors within the group (721) may be included within the printhead (710).

Further, two groups of printhead dies (720) are overmolded into a common monolithic portion of moldable substrate (102) where the moldable substrate is formed in an s-shape as described above in connection with FIG. 5D. Thus, as mentioned above, the plurality of s-shaped moldable substrates (102) within the array of FIG. 7A nest and overlap with one another such that portions of neighboring printheads (710) overlap with one another. Again, stitching processes may be used between printhead dies (720) within the same monolithic portion (710) of moldable substrate (102), between neighboring monolithic printheads (710) that overlap one another, or combinations thereof.

Further, the monolithic printhead dies (710) of FIG. 7A include a number of tape-automated bonding (TAB) circuit interconnects (750) electrically coupling each monolithic printhead die (710) to a controller of a printing device into which the monolithic printhead dies (710) are included. Tape-automated bonding (TAB) is a process that places, for example, printhead dies (720) onto a printed circuit board (PCB) by attaching them to fine conductors in a polyamide or polyimide film to provide for direct connection to external circuits such as those found within the electronics of the printing device. In a TAB arrangement, mounting is done such that the bonding sites of the printhead die (720), in some examples in the form of bumps or balls made of gold or solder, are connected to fine conductors on the tape. This provides a connection between the printhead dies (720) of the monolithic printheads (710) to external circuits.

Figure 7B:
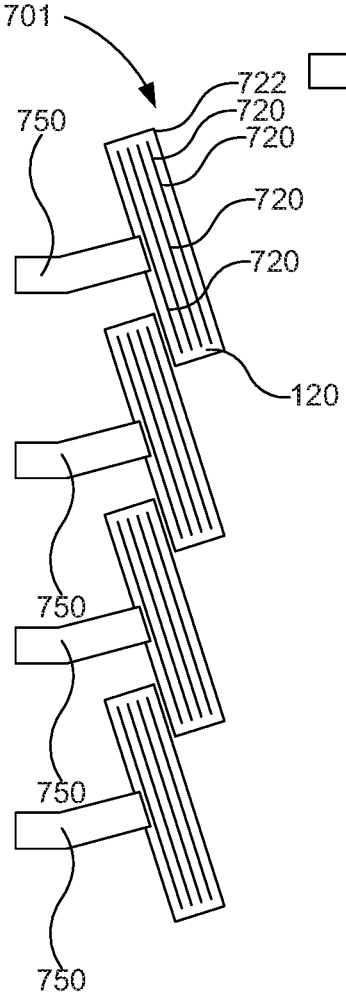
FIG. 7B is a diagram of a printhead array with individual rotated dies in a TAB circuit interconnect arrangement, according to one example of the principles described herein.

FIG. 7B is a diagram of a printhead array (701) with individual rotated printheads (722) in a TAB circuit interconnect arrangement, according to one example of the principles described herein. In the example of FIG. 7B, the printheads (722) may be rotated at any degree with respect to a print path direction (780). This may shorten the overall length of the printhead array (701). In addition, individual printheads (722) within the array (701) may include printhead dies (720) that overlap with printhead dies (720) of neighboring printheads (722) allowing for a stitching process to be implemented between printheads (722). Further, a number of TAB circuit interconnects (750) may electrically couple each printhead (722) to the electronics of the printing device.

Figure 7C:
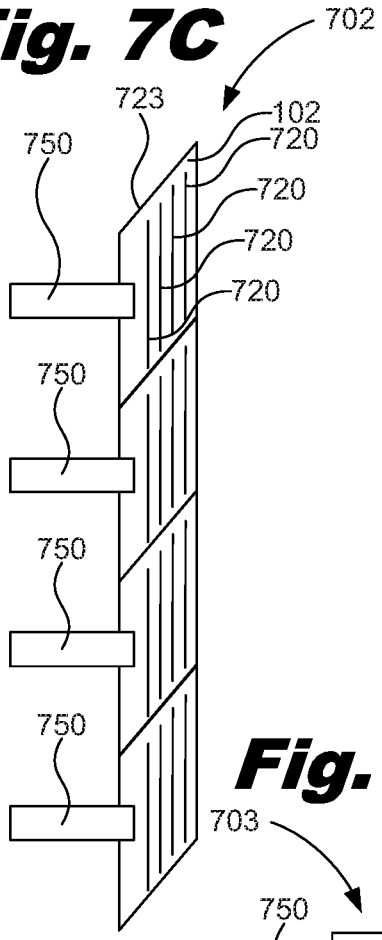
FIG. 7C is a diagram of a printhead array with slanted printheads in a TAB circuit interconnect arrangement, according to one example of the principles described herein.

FIG. 7C is a diagram of a printhead array (702) with slanted printheads (723) in a TAB circuit interconnect arrangement, according to one example of the principles described herein. In the example of FIG. 7C, a plurality of printhead dies (720) may be included within each printhead (723) such that the rows of nozzles (201) are arranged in an offset arrangement with respect to the print path direction (780). In this manner, less than the entirety of the printhead dies (720) overlap one another. Each printhead (723) in the array (702) includes a slant edge. In one example, the printheads (723) may include a moldable substrate (102) including an edge shape similar to the sloped edge shape depicted in FIG. 6B. In this example, the printheads (723) are able to be aligned by allowing the indention (602) defined in a first side of the sloped edge shape to engage with a complimentary fitting protrusion (603) on a second side.

Figure 7D:
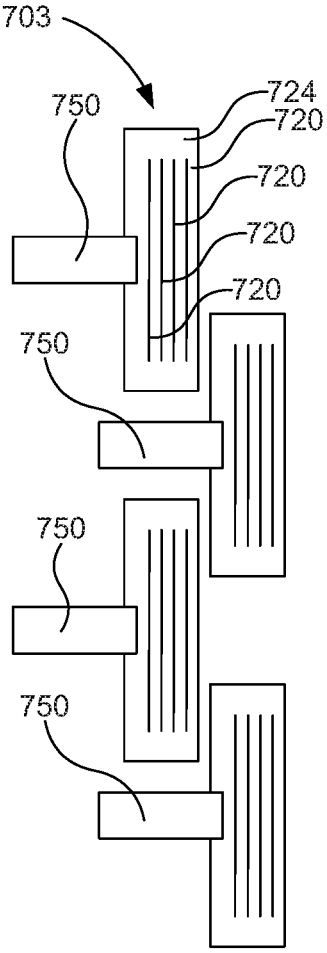
FIG. 7D is a diagram of a printhead array with individual printheads in a TAB circuit interconnect page-wide array (PWA) arrangement, according to one example of the principles described herein.
Figure 7D:
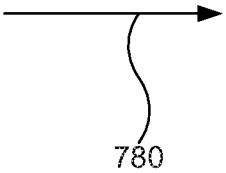

FIG. 7D is a diagram of a printhead array (703) with individual printheads (724) in a TAB circuit interconnect page-wide array (PWA) arrangement, according to one example of the principles described herein. In the example of FIG. 7D, a number of individual printheads (724) are arranged in a staggered arrangement. A PWA (703) may include a print bar with a number of printheads (724) included therein, where the print width of the PWA (703) covers an entire printable width of a print medium. In one example, the PWA (703) may include a number of individual printheads (724). In this example, the individual printheads (724) are each formed in the moldable substrate (102) on an individual basis or are formed in a common monolithic portion of a moldable substrate (102) and cut apart from one another. In another example, the printheads (724) of the PWA (703) may be formed in a common monolithic portion of a moldable substrate (102), and coupled to a print bar in that form.

In relation to the PWA (703) of FIG. 7D, the printheads (724) of the examples described herein may be arranged in an array of printheads (724) to form a print bar or a page-wide array (PWA) as depicted in the examples of FIGS. 8A through 8D. Each of the examples of PWAs (800, 801, 802, 803) depicted in FIGS. 8A through 8D include a moldable substrate (102) with a number of printhead dies (720) overmolded into the moldable substrate (102). Further, each PWA (800, 801, 802, 803) includes a PWA edge connector (820) to electrically and communicatively couple the PWAs (800, 801, 802, 803) to a printing device into which the PWAs (800, 801, 802, 803) are installed. Electrical traces may be formed in the moldable substrate (102) so that the individual printhead dies (720) may be electrically and communicatively coupled to the PWA edge connector (820).

In the examples of FIGS. 8A through 8D, the printhead dies (720) may be molded into the moldable substrate (102) together to form a single monolithic substrate. In another example, the printhead dies (720) are embedded in the moldable substrate (102) without being molded together as individual printhead dies (101) first.

Figure 8A:
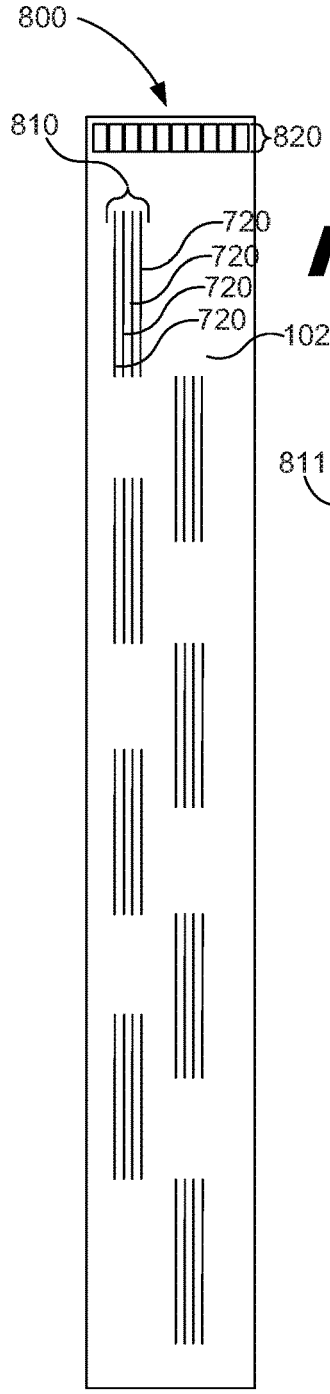
FIG. 8A is a diagram of a printhead die PWA with groups of printhead dies in a staggered arrangement, according to one example of the principles described herein.

FIG. 8A is a diagram of a printhead die PWA (800) with groups (810) of printhead dies (720) in a staggered arrangement, according to one example of the principles described herein. The PWA (800) of FIG. 8A may include a printhead die (720) arrangement similar to that of FIG. 7D except that the printhead die (720) are formed in the same monolithic moldable substrate (102).

Figure 8B:
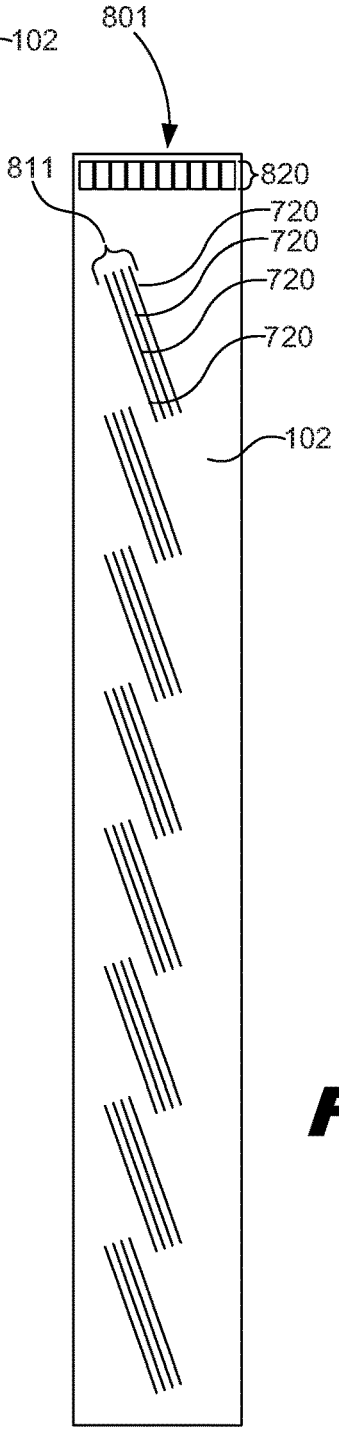
FIG. 8B is a diagram of a printhead die PWA with groups of printhead dies in a rotated arrangement, according to one example of the principles described herein.

FIG. 8B is a diagram of a printhead die PWA (801) with groups (811) of printhead dies (720) in a rotated arrangement, according to one example of the principles described herein. The PWA (801) of FIG. 8B may include a printhead die (720) arrangement similar to that of FIG. 7B except that, again, the printhead die (720) are formed in the same monolithic moldable substrate (102).

Figure 8C:
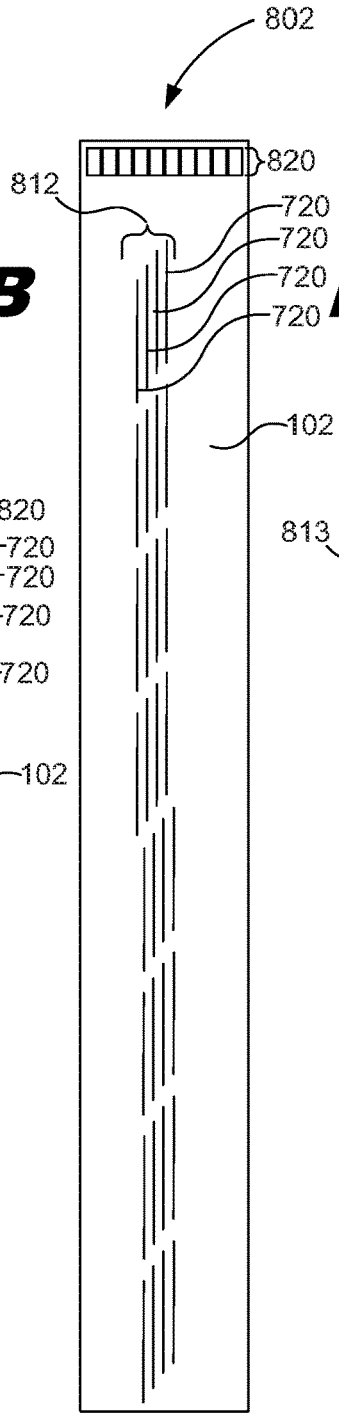
FIG. 8C is a diagram of a printhead die PWA with groups of printhead dies in a slanted arrangement, according to one example of the principles described herein.

FIG. 8C is a diagram of a printhead die PWA (802) with groups (812) of printhead dies (720) in a slanted arrangement, according to one example of the principles described herein. The PWA (802) of FIG. 8C may include groups (812) of printhead dies (720) that are arranged in a cascading arrangement. The arrangement of printhead dies (720) in FIG. 8C within the moldable substrate (102) may be similar to that of FIG. 7C except that, again, the printhead die (720) are formed in the same monolithic moldable substrate (102).

Figure 8D:
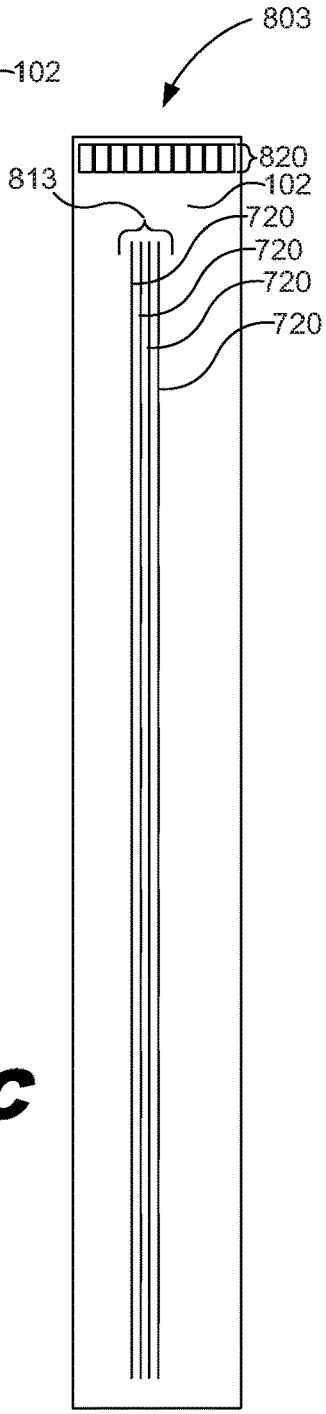
FIG. 8D is a diagram of a printhead die PWA with groups of printhead dies in a straight arrangement, according to one example of the principles described herein.

FIG. 8D is a diagram of a printhead die PWA (803) with groups (813) of printhead dies (720) in a straight arrangement, according to one example of the principles described herein. The PWA (803) of FIG. 8D may include a printhead die (720) arrangement where the printhead dies (720) are located next to each other such that the nozzles (201) of each printhead die (720) are able to cover the entire print medium without gaps between ink coverage.

Figure 9A:
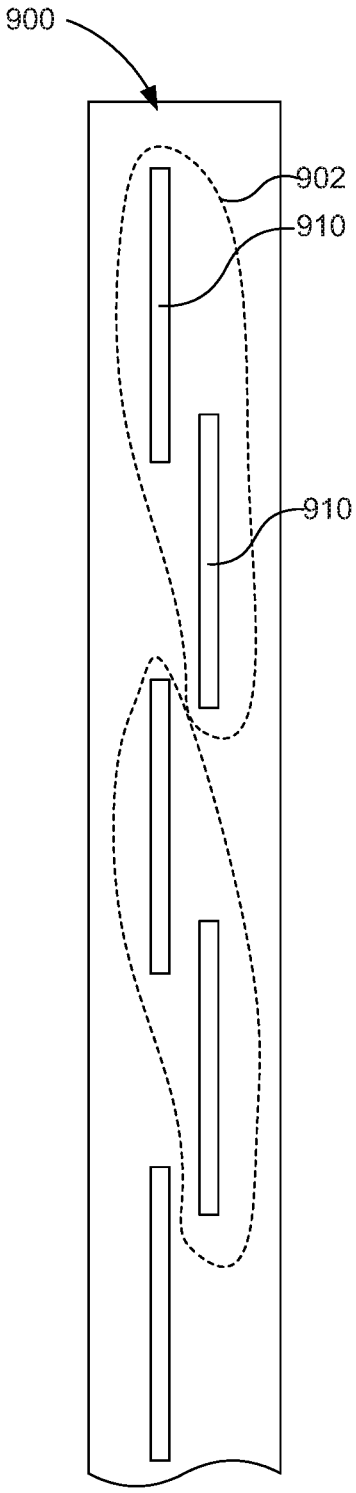
FIG. 9A is a diagram of a printhead die PWA with groups of printhead dies in a staggered arrangement with a two printhead grouping, according to one example of the principles described herein.
Figure 9B:
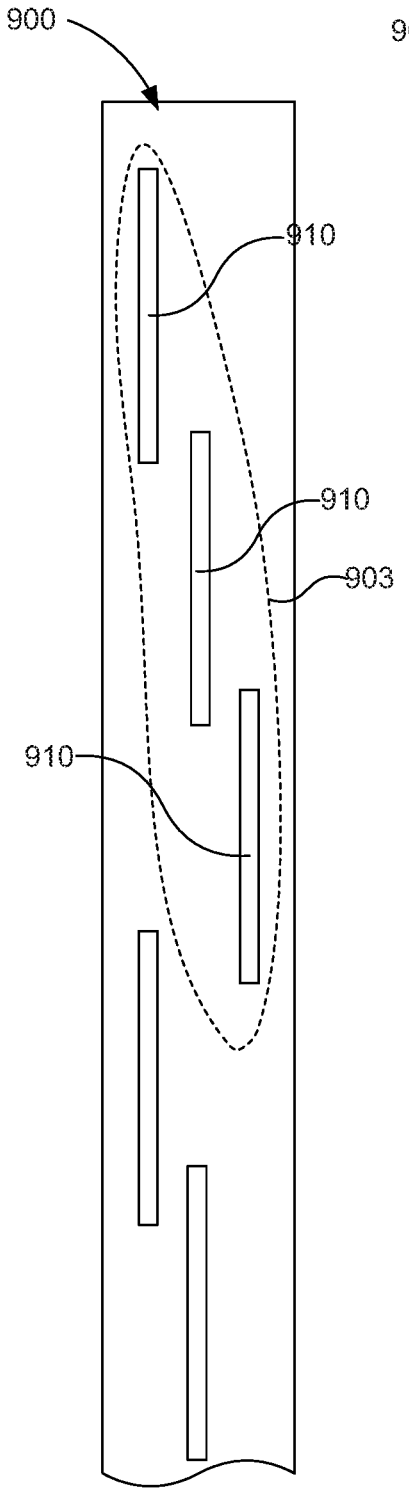
FIG. 9B is a diagram of a printhead die PWA with groups of printhead dies in a staggered arrangement with a three printhead grouping, according to one example of the principles described herein.
Figure 9C:
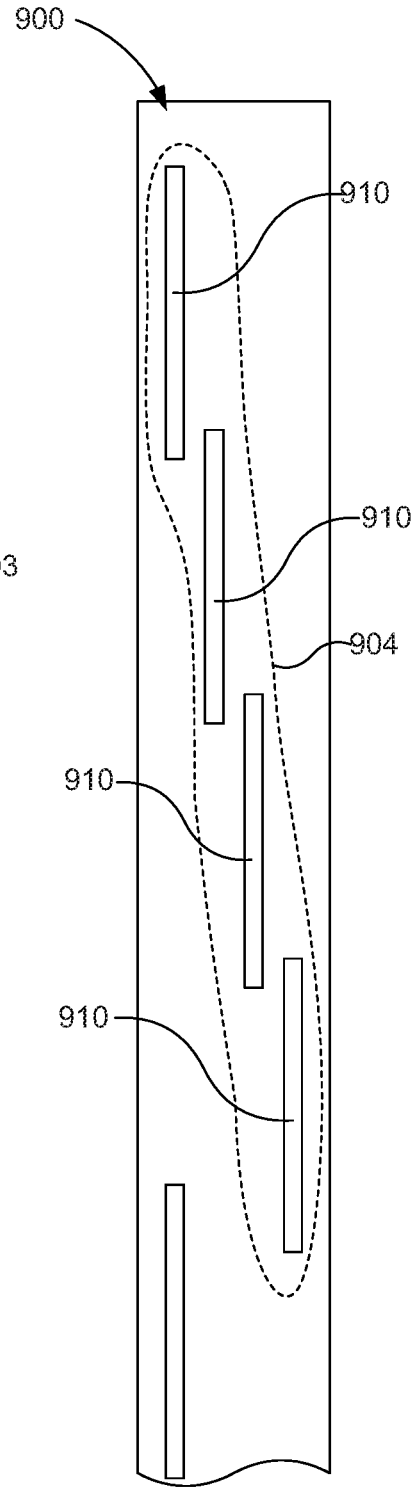
FIG. 9C is a diagram of a printhead die PWA with groups of printhead dies in a staggered arrangement with a four printhead grouping, according to one example of the principles described herein.

Within the examples of FIGS. 8A through 8D, the printhead dies (720) may be grouped in a number of groupings. These groups of printhead dies (720) may eject jettable fluid such that the printhead dies (720) produce a printed image. For example, FIG. 9A is a diagram of a printhead die PWA (900) with groups (910) of printhead dies (720) in a staggered arrangement with a two group (910) grouping (902), according to one example of the principles described herein. The groups (910) FIGS. 9A through 9C may include any number of printhead dies (720). Similarly, FIG. 9B is a diagram of a printhead die PWA (901) with groups (910) of printhead dies (720) in a staggered arrangement with a three group (910) grouping (903), according to one example of the principles described herein. Further, FIG. 9C is a diagram of a printhead die PWA (902) with groups (910) of printhead dies (720) in a staggered arrangement with a four group (910) grouping (904), according to one example of the principles described herein.

With each of the printhead die (720) arrangements described herein including, for example, those described in connection with FIGS. 7A through 9C, electrical connections may be made between the printhead dies (720) and the PWA edge connector (820). In a PWA, the individual printhead die (720) may be located a distance from the edge of the PWA. Thus, in some examples, a number of vias may be formed in the moldable substrate (102) in which the printhead dies (720) are overmolded. The vias allow for bond wires to couple to an underlying substrate such as a printed circuit board (PCB) located underneath the moldable substrate (102) as depicted in FIG. 1. The PCB, through the use of a number of electrical traces located within the PCB, may then electrically and communicatively couple the bond wires to the PWA edge connector (820).

Figure 10A:
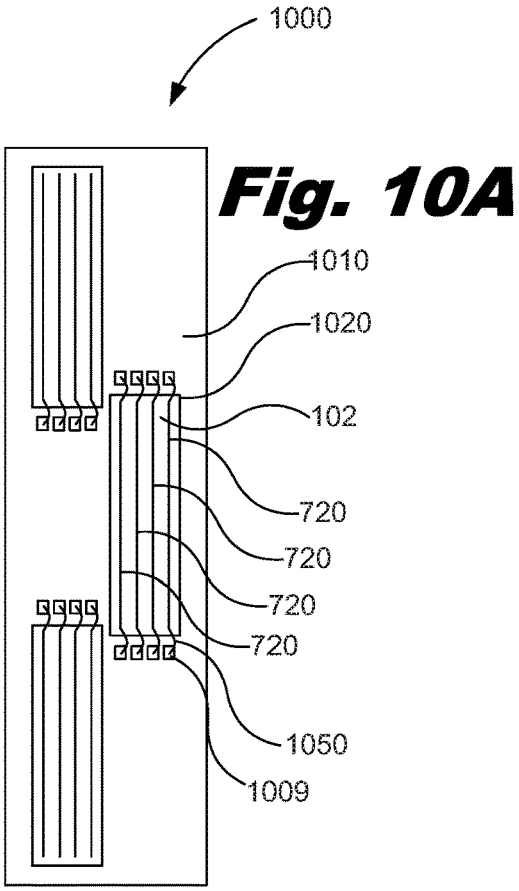
FIG. 10A is a diagram of a printhead array with individual printheads including printhead dies in a staggered arrangement on a printed circuit board (PCB) including printhead die interconnect arrangements, according to one example of the principles described herein.

FIG. 10A is a diagram of a printhead array (1000) with individual printheads (1020) including printhead dies (720) in a staggered arrangement on a printed circuit board (PCB) (1010) including printhead die interconnect arrangements, according to one example of the principles described herein. In the example of FIG. 10A, individual printheads (1020) with printhead dies (720) overmolded within the molded substrate (102) are arranged on the PCB (1010). The printhead dies (720) are electrically coupled to the PCB (1010) at the ends of the printhead dies (720) since the PCB (1010) is exposed. In this example, a number of bond wires (1050) are extended from the printhead dies (720) of the printheads (1020) to a number of bond pads (1009) located on or within a layer of the PCB (1010).

Figure 10B:
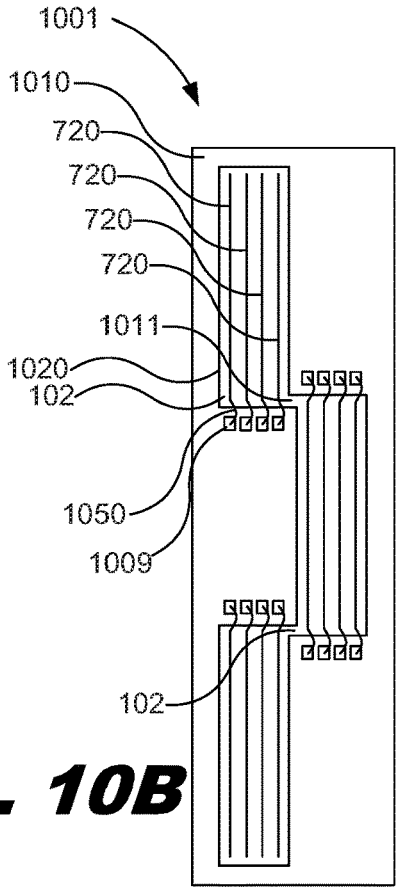
FIG. 10B is a diagram of a printhead array with connected printheads in a staggered arrangement on a PCB including printhead die interconnect arrangements, according to one example of the principles described herein.

As another example, FIG. 10B is a diagram of a printhead array (1001) with connected printheads (1020) in a staggered arrangement on a PCB (1010) including printhead die interconnect arrangements, according to one example of the principles described herein. As depicted in FIG. 10B, the printheads (1020) are formed in a monolithic moldable substrate (102) where the printheads (1020) are coupled together using a portion (1011) of moldable substrate (102) located towards the ends of the printheads (1020). In one example, the printheads (1020) are all formed together one a single moldable substrate (102), and separated from one another to obtain the staggered configuration depicted in FIG. 10B. In this manner, the printheads (1020) are formed in a single overmolded substrate. In this example, the printheads (1020) are electrically coupled to the PCB (1010) at the ends of the printhead dies (720) of the printheads (1020) in a similar manner as described above in connection with FIG. 10A since the PCB (1010) is exposed. In this example, a number of bond wires (1050) are extended from the printhead dies (720) of the printheads (1020) to a number of bond pads (1009) located on or within a layer of the PCB (1010).

Figure 10C:
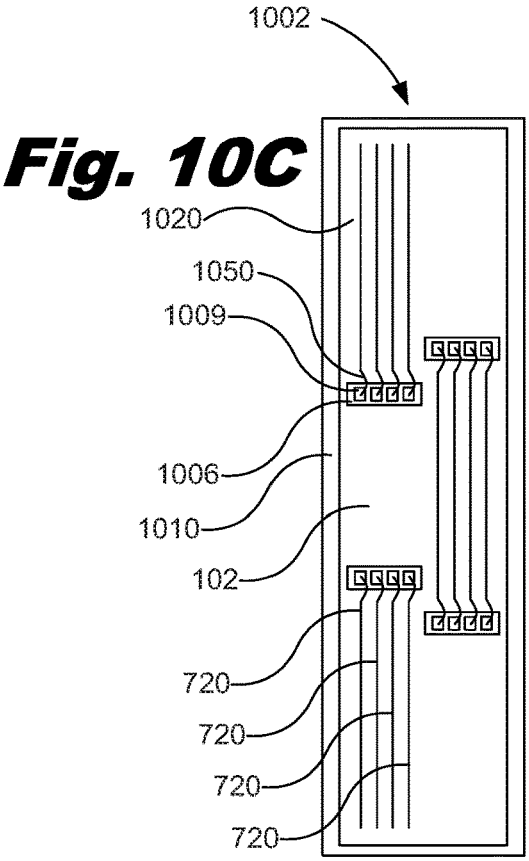
FIG. 10C is a diagram of a printhead array with connected printheads in a staggered arrangement on a PCB including via interconnect arrangements located at the ends of the printhead dies, according to one example of the principles described herein.

FIG. 10C is a diagram of a printhead array (1002) with connected printheads (1020) in a staggered arrangement on a PCB (1010) including via interconnect arrangements (1006) located at the ends of the printheads (1020), according to one example of the principles described herein. The printheads (1020) of FIG. 10C are formed in a monolithic moldable substrate (102) where the printheads (1020) are coupled together using and surrounded by the moldable substrate (102). Thus, the printheads (1020) are arranged as groups within the same monolithic moldable substrate (102). In this example, the wire bonds (1050) that electrically and communicatively couple the printhead dies (720) of the printheads (1020) are not able to access a portion of the PCB (1010) due to the monolithic moldable substrate (102) covering the entirety of the PCB (1010). Thus, a number of vias (1006) may be formed in the moldable substrate (102) to allow the bond wires (1050) to pass through the moldable substrate (102), and couple with the PCB (1010) to provide electrical and communicative coupling of the printhead dies (720) to the printing device. In one example, the PCB (1010) may include a number of redistribution layers or electrical traces to move the electrical signals from one area of the moldable substrate (102) and PCB (1010) to another in order to interface with, for example, a printing device.

Figure 10D:
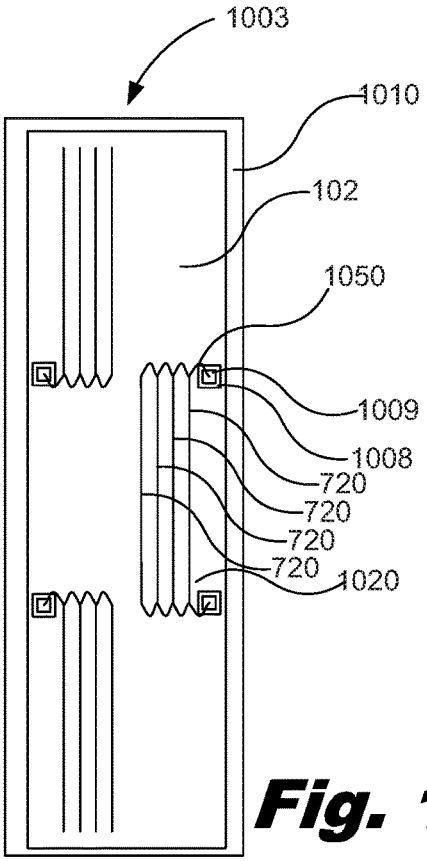
FIG. 10D is a diagram of a printhead array with connected printheads in a staggered arrangement on a PCB including side via interconnect arrangements, according to one example of the principles described herein.

FIG. 10D is a diagram of a printhead array (1003) with connected printheads (1020) in a staggered arrangement on a PCB (1010) including side via (1008) interconnect arrangements, according to one example of the principles described herein. The printheads dies (720) of FIG. 10D are formed in a monolithic moldable substrate (102) where the printhead dies (101) are coupled together using and surrounded by the moldable substrate (102). Thus, like the example of FIG. 10C, a number of vias (1008) may be formed in the moldable substrate (102) to allow for passage of the bond wires (1050) from the printhead dies (720) to the PCB. In the example of FIG. 10D, however, the vias (1008) are formed in the side of the printhead dies (720) instead of the ends as depicted in FIG. 10C.

Figure 11:
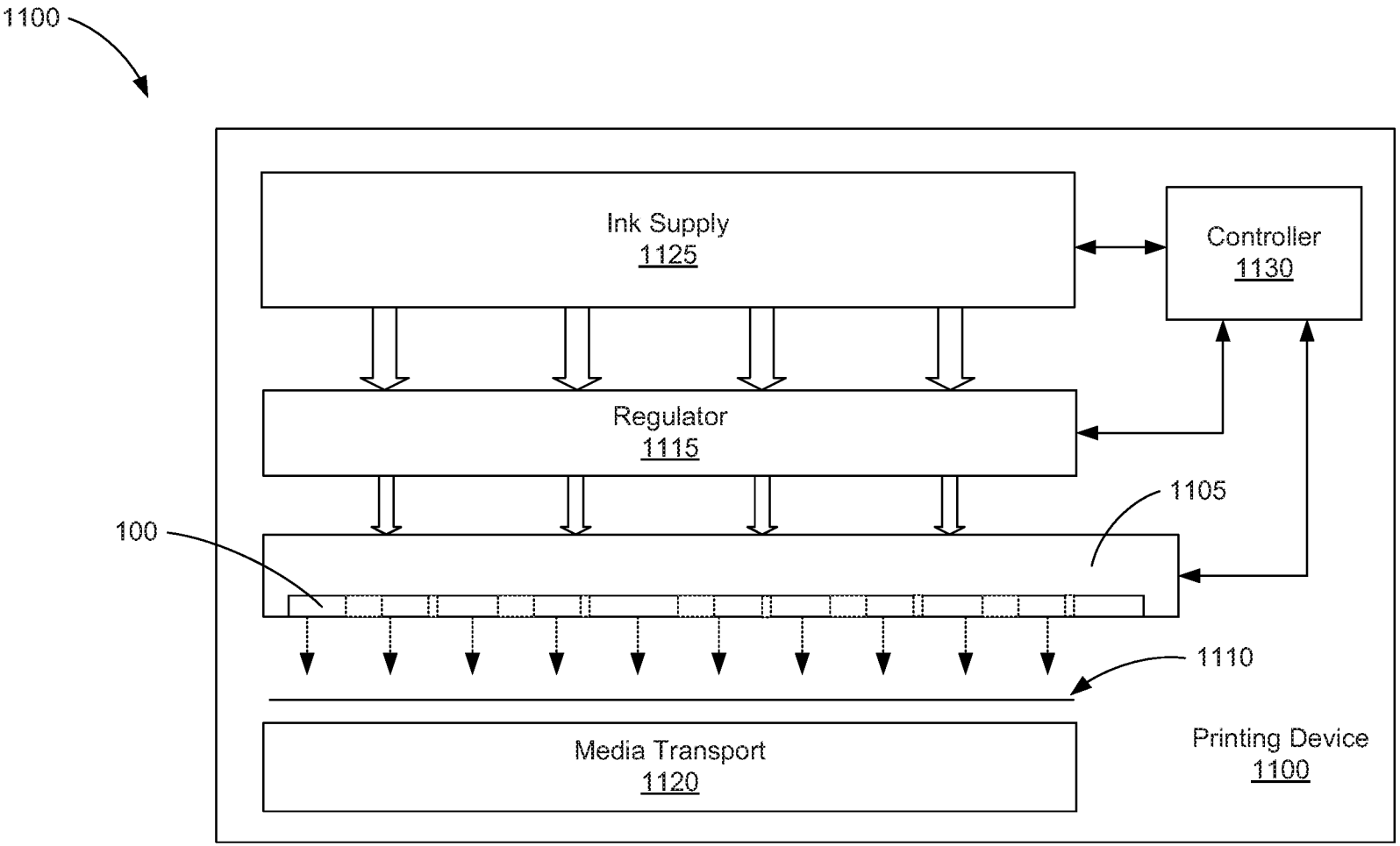
FIG. 11 is a block diagram of a printing device, according to one example of the principles described herein.

FIG. 11 is a block diagram of a printing device, according to one example of the principles described herein. FIG. 11 includes a printing device (1100) including a print bar (1105) including a number of molded printhead dies (101) according to one example of the principles described herein. The printing device (1100) may include a print bar (1105) that, in one example, spans the width of a print media (1110). The printer (1100) may further include flow regulators (1115) associated with the print bar (1105); a media transport mechanism (1120), ink or other jettable fluid supplies (1125), and a printer controller (1130). The controller (1130) may represent the programming, processor, and associated data storage device(s), and the electronic circuitry and components needed to control the operative elements of the printing device (1100). The print bar (1105) may include an arrangement of molded printhead dies (101) for dispensing jettable fluid onto a sheet or continuous web of paper or other print media (1110). The print bar (1105) in FIG. 11 includes multiple molded printhead dies (100) spanning print media (1110). However, different print bars (1105) are contemplated in the present specification that may include more or less printheads (100) and may be fixed to a page wide array bar as depicted in FIG. 11 or on a movable print cartridge.

Figure 12:
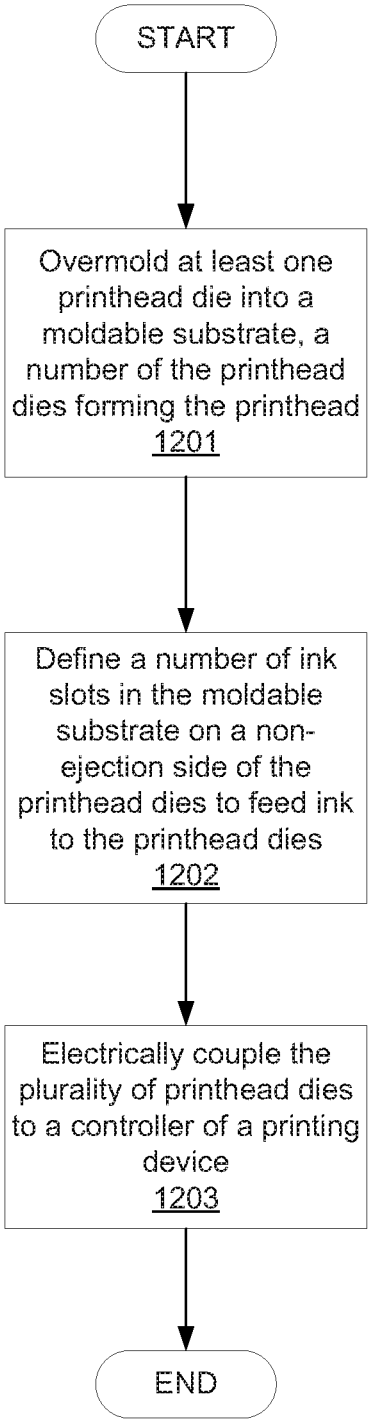
FIG. 12 is a flowchart showing a method of forming a printhead die, according to one example of the principles described herein.

FIG. 12 is a flowchart showing a method of forming a printhead die (101), according to one example of the principles described herein. The method of FIG. 12 may begin by overmolding (block 1201) at least one inkjet printhead die (101) into a moldable substrate (102). Further, a number of printhead dies (101) form a printhead or, as described above, a printhead die array or a page-wide array (PWA).

A number of ink slots may be defined (block 1202) in the moldable substrate (102) on a non-ejection side of the printhead dies (101) to feed ink to the inkjet printhead dies (101). The method may continue by electrically coupling (block 1203) the plurality of printhead dies (101) to the controller (1130) of the printing device (1100). In one example, the plurality of printhead dies (101) are electrically coupled to the controller (1130) as a number of groups (902) of printhead dies (101). In one example, the method may further include defining a number of vias (1006) in the moldable substrate (102) through which a number of wire bonds (1050) are extended to electrically couple the inkjet printhead dies (101) to the controller (1130).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the controller (1130) of the printing device (1100) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a printhead. The printhead includes a moldable substrate, and a number of printhead dies molded into the moldable substrate. The printhead dies include a number of inkjet rows of nozzles and their respective corresponding circuitry and resistive heating elements molded into the moldable substrate. The rows of nozzles and their respective corresponding circuitry and resistive heating elements form the printhead dies within the printhead. The dies comprise a non-rectangular shape. A number of ink slots are defined in the moldable substrate to fluidically coupled to the rows of nozzles and their respective corresponding circuitry and resistive heating elements of the printhead dies to feed ink to the rows of nozzles and their respective corresponding circuitry and resistive heating elements. The number of ink slots is not equal to the number of printhead dies.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead comprising:

a moldable substrate; and a number of dies molded into the moldable substrate, the dies comprising:

a number of rows of nozzles, the rows of nozzles forming the dies within the printhead, wherein a longitudinal axis of each die is rotated with respect to a longitudinal axis of the molded substrate.

2. The printhead of claim 1, wherein a plurality of die are overmolded together in the same moldable substrate.

3. The printhead of claim 1, wherein the moldable substrate comprises a number of vias defined therein, and a number of wire bonds electrically couple the plurality of die to a printed circuit board (PCB) through the vias.

4. The printhead of claim 1, wherein the moldable substrate is formed of an epoxy.

5. A printhead comprising:

a moldable substrate;

a number of dies molded into the moldable substrate, the dies comprising:

a number of rows of nozzles, the rows of nozzles forming the dies within the printhead, wherein the moldable substrate comprises a non-rectangular shape; and wherein the non-rectangular shaped moldable substrate comprises a slopped edge shape, a chamfered edge shape, or a pentangle edge shape.

6. The printhead of claim 5, wherein a plurality of dies are molded in the moldable substrate, the plurality of dies being arranged within the moldable substrate to conform to the non-rectangular shape of the moldable substrate.

7. The printhead of claim 5, wherein the number of dies molded into the moldable substrate comprises a plurality of dies, and wherein the non-rectangular shaped moldable substrate are arranged in a stitching configuration.

8. The printhead of claim 5, wherein the moldable substrate comprises a number of fluid slots defined within the moldable substrate to feed fluid to the dies, wherein the fluid slots defined within the moldable substrate are narrower than a width of the dies.

9. The printhead of claim 5, wherein the moldable substrate comprises a number of fluid slots defined within the moldable substrate to feed fluid to the dies, wherein the fluid slots defined within the moldable substrate are wider than a width of the dies.

10. A printhead comprising:

a moldable substrate;

a number of dies molded into the moldable substrate; and a number of fluid slots defined in the moldable substrate fluidically coupled to the dies to feed fluid to the dies, wherein the number of fluid slots is not equal to the number of dies; and wherein one of the fluid slots is fluidly coupled to ends of two adjacent dies, a different fluid slot being fluidly coupled to the opposite ends of each of the two adjacent dies.

11. The die of claim 10, wherein a plurality of the fluid slots are fluidically coupled to a single die.

12. The die of claim 10, wherein a single fluid slot defined within the moldable substrate is fluidically coupled to at least two dies.

13. The die of claim 10, wherein at least one of the fluid slots defined in the moldable substrate has a non-centered alignment with respect to one of the dies.

14. The die of claim 10, wherein the printhead does not comprise a fan-out chiclet.

15. The printhead of claim 10, further comprising two fluid slots formed in the moldable substrate for each die, each fluid slot being fluidly coupled to only one end of one of the die.

16. The printhead of claim 10, wherein one of the fluid slots is fluidly coupled along just one of two opposite sides of one of the dies.

17. A method of forming a printhead comprising:

overmolding at least one printhead die into a moldable substrate, a number of the printhead dies forming the printhead;

defining a number of fluid slots in the moldable substrate on a non-ejection side of the printhead dies to feed fluid to the printhead dies; and electrically coupling the plurality of printhead dies to a controller of a printing device, wherein the plurality of printhead dies are electrically coupled to the controller as a number of groups of printhead dies.

18. The method of claim 17, further comprising defining a number of vias in the moldable substrate through which a number of wire bonds are extended to electrically couple the printhead dies to the controller.

* * * * *